US012759776B2

(12) United States Patent
Beilke et al.

(10) Patent No.: US 12,759,776 B2
(45) Date of Patent: Oct. 13, 2026

(54) CLOSURE, CONTAINER, AND ASSEMBLY THEREOF

(71) Applicant: AptarGroup, Inc., Crystal Lake, IL (US)

(72) Inventors: Stacy L. Beilke, East Troy, WI (US); Timothy Mazurkiewicz, Waukesha, WI (US); Christopher Max, Libertyville, IL (US); Noah Gajda, Palatine, IL (US)

(73) Assignee: AptarGroup, Inc., Crystal Lake, IL (US)

( * ) Notice: Subject to any disclaimer, the term of this patent is extended or adjusted under 35 U.S.C. 154(b) by 158 days.

(21) Appl. No.: 18/867,122

(22) PCT Filed: Jun. 13, 2023

(86) PCT No.: PCT/US2023/025109

§ 371 (c)(1),
(2) Date: Nov. 19, 2024

(87) PCT Pub. No.: WO2023/244556

PCT Pub. Date: Dec. 21, 2023

(65) Prior Publication Data

US 2025/0346416 A1 Nov. 13, 2025

Related U.S. Application Data

(60) Provisional application No. 63/353,554, filed on Jun. 18, 2022.

(51) Int. Cl.
*B65D 55/02* (2006.01)
*B65D 47/08* (2006.01)

(52) U.S. Cl.
CPC ..... *B65D 55/022* (2013.01); *B65D 47/0838* (2013.01)

(58) Field of Classification Search
CPC ..... B65D 55/022; B65D 47/08047
(Continued)

(56) References Cited

U.S. PATENT DOCUMENTS 4,128,184 A 12/1978 Northrup
4,270,664 A * 6/1981 Buono ..... B65D 50/046 215/217

(Continued)

FOREIGN PATENT DOCUMENTS

CN 102046485 A 5/2014
EP 1502871 B1 8/2007

(Continued)

OTHER PUBLICATIONS

International Search Report and Written Opinion dated Aug. 28, 2023 for PCT/US2023/025109 of which this is the U.S. national phase application.

*Primary Examiner* — Nathan J Jenness
*Assistant Examiner* — Jennifer Castriotta
(74) *Attorney, Agent, or Firm* — Wood, Phillips, Katz, Clark & Mortimer

(57) ABSTRACT

A closure (40) is provided for use in restricting access to a substance that may be stored within a container (44) having at least one laterally extending flange (76) located laterally outwardly of an opening (46) of the container (44). The closure (40) has a body (54) having a deck (58) including at least one orifice (60). The body (54) has an internal wall (62) depending from the deck (58) with means for attaching the closure (40) to the container (44) and the body (54) includes at least one torque rib (74) extending therefrom for confronting at least one laterally extending flange (76) of the container (44) to inhibit relative rotation between the body (54) and the container (44). The at least one torque rib (74) is non-planar.

20 Claims, 21 Drawing Sheets

FIG. 20

(58) Field of Classification Search
USPC ..... 215/330
See application file for complete search history.

(56) References Cited

U.S. PATENT DOCUMENTS

| | | | | |
|---|---|---|---|---|
| 4,662,530 | A * | 5/1987 | Goncalves ..... | B65D 41/0471 215/331 |
| 5,145,080 | A | 9/1992 | Imbery, Jr. | |
| 6,152,315 | A | 11/2000 | Montgomery | |
| 6,168,035 | B1 | 1/2001 | McLelland | |
| 2005/0205607 | A1 * | 9/2005 | Hierzer ..... | B65D 47/0804 222/546 |
| 2008/0296251 | A1 | 12/2008 | Johnston et al. | |
| 2008/0314860 | A1 | 12/2008 | Pugne et al. | |
| 2016/0280429 | A1 | 9/2016 | Piscopo | |

FOREIGN PATENT DOCUMENTS

| | | | |
|---|---|---|---|
| EP | 1847469 | A2 | 10/2007 |
| WO | 1998039228 | A1 | 9/1998 |

* cited by examiner

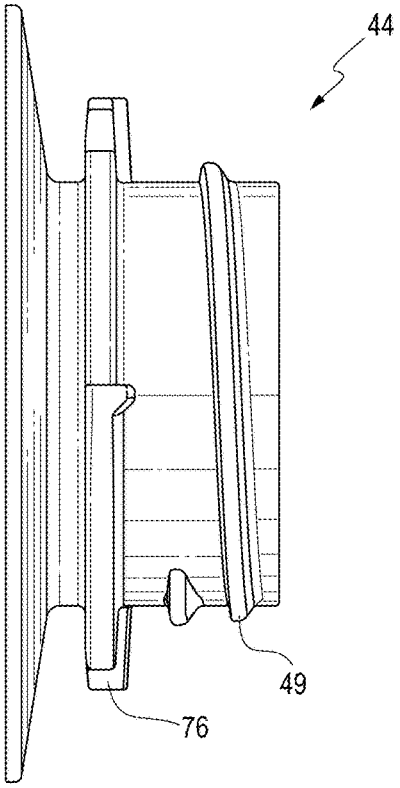
FIG. 9
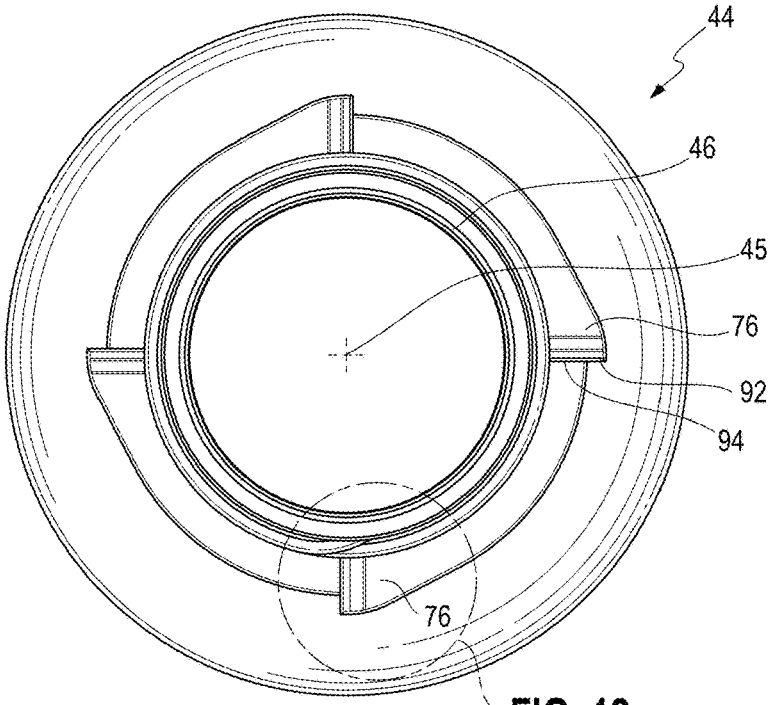
FIG. 10
FIG. 12

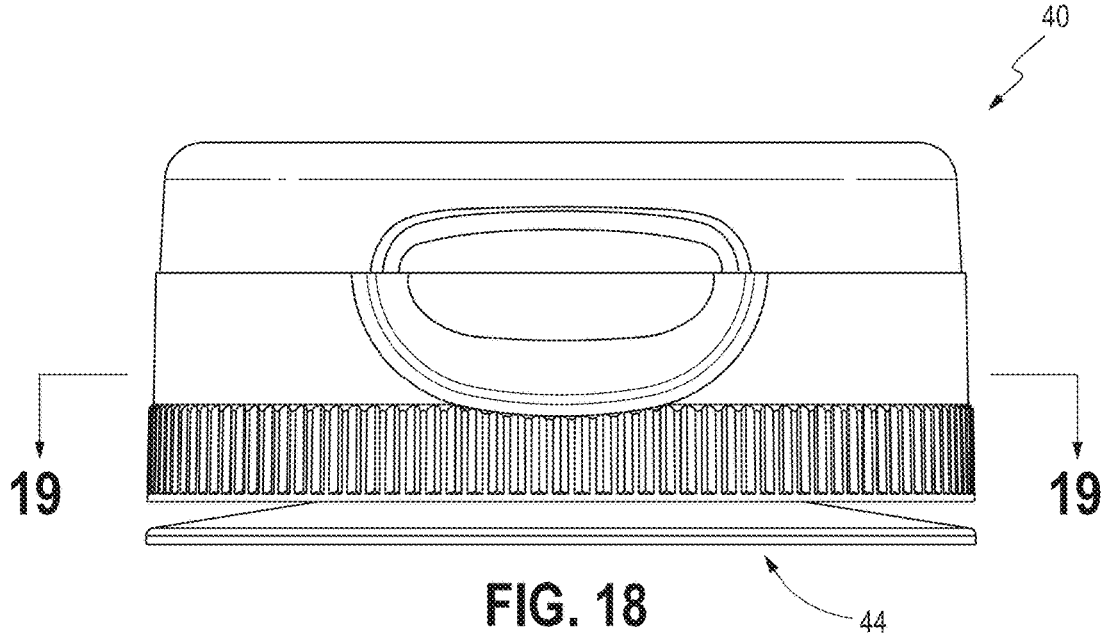
FIG. 18
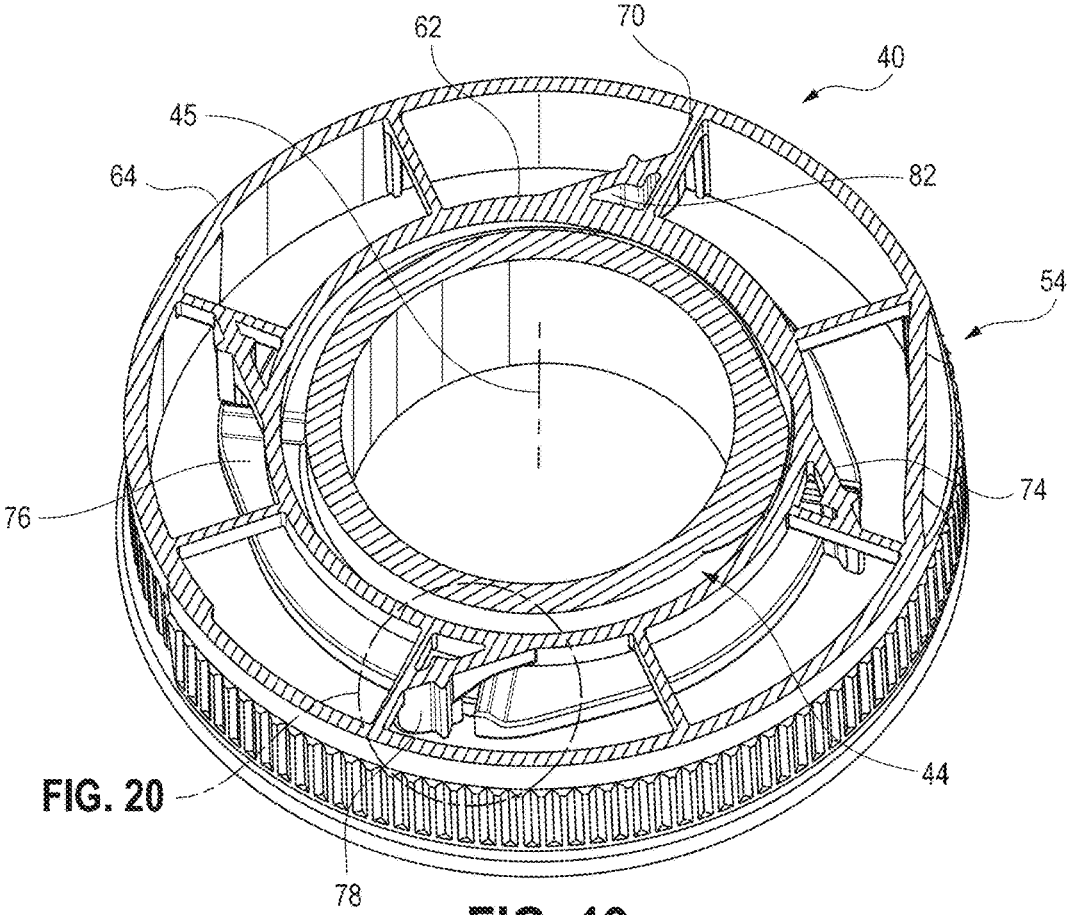
FIG. 20
FIG. 19

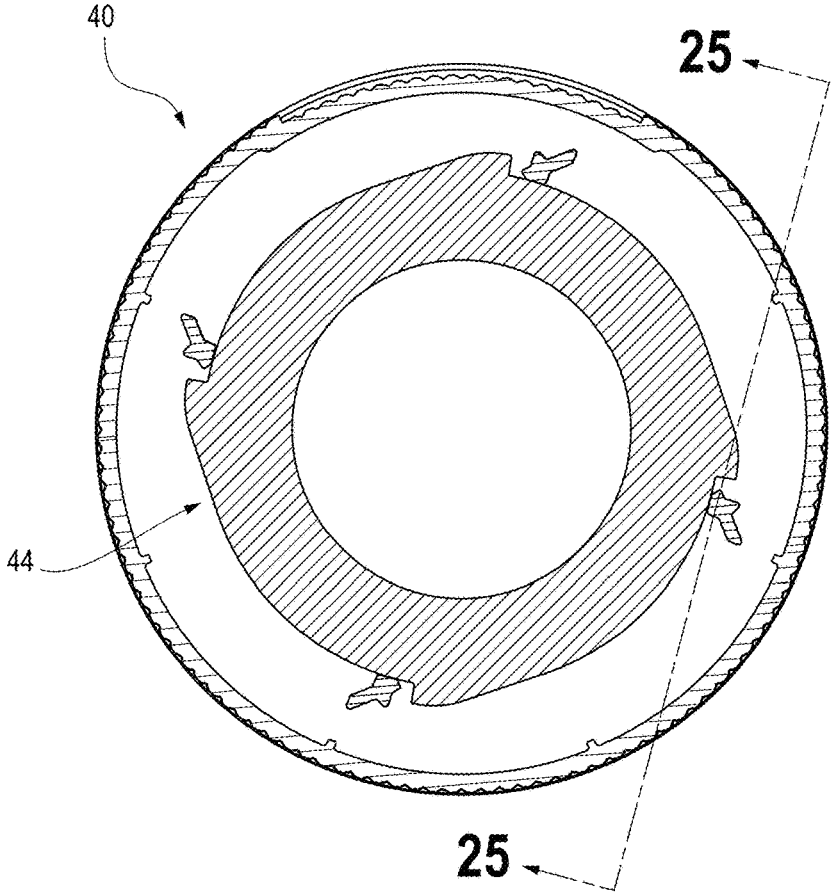
FIG. 24
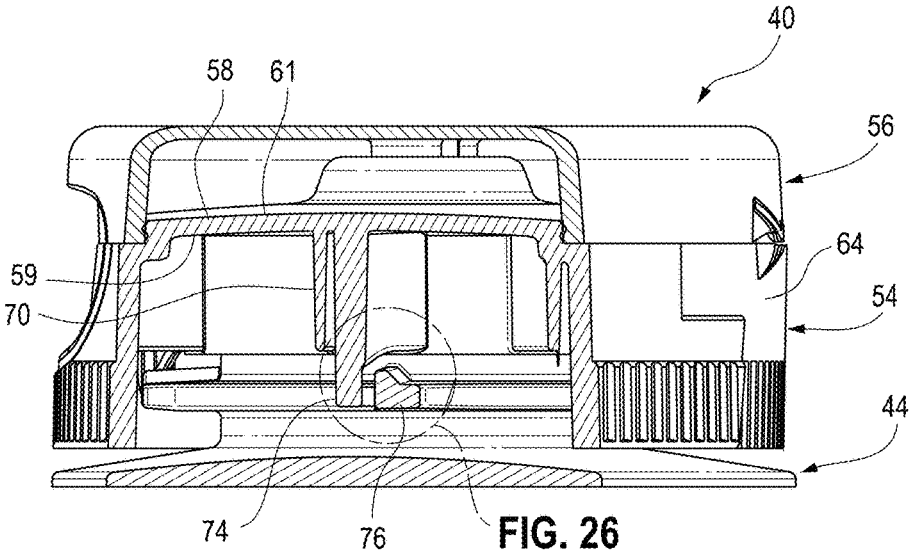
FIG. 26
FIG. 25

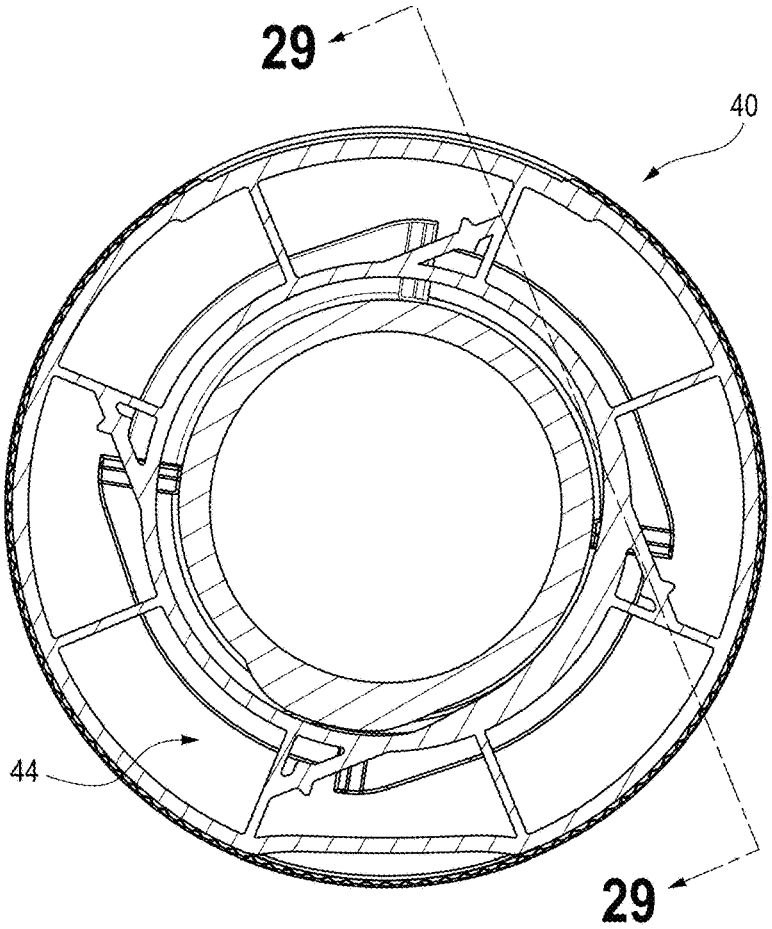
FIG. 28
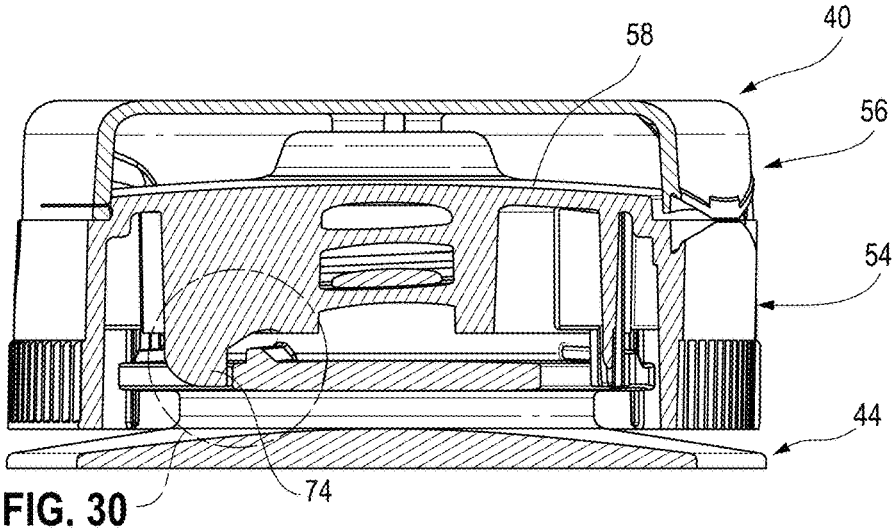
FIG. 30
FIG. 29

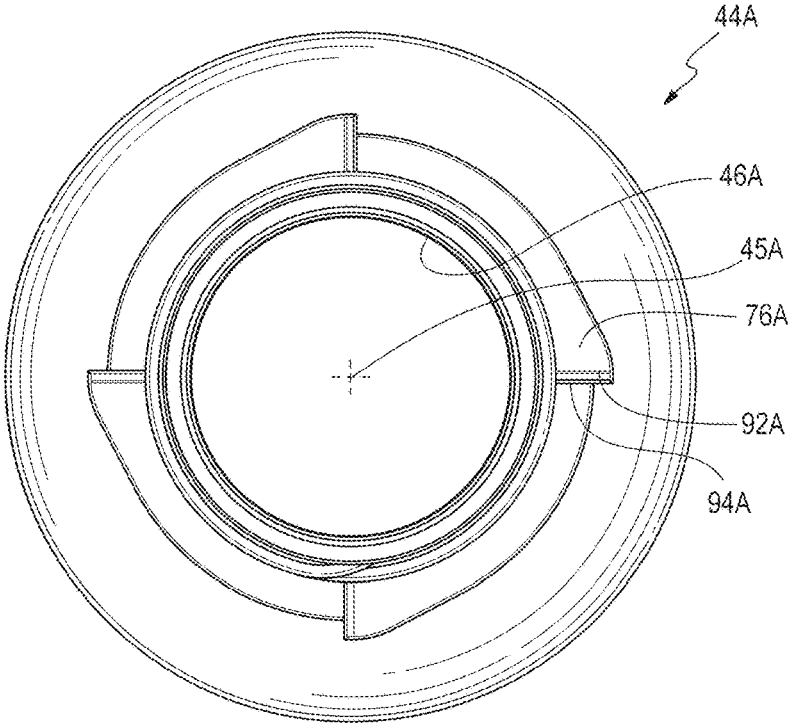
FIG. 32
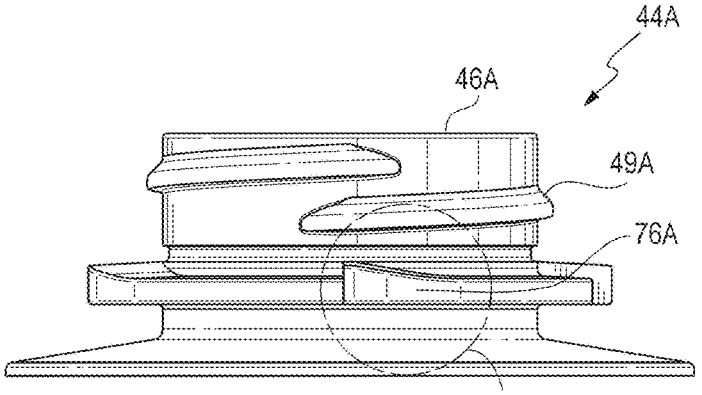
FIG. 33
FIG. 34
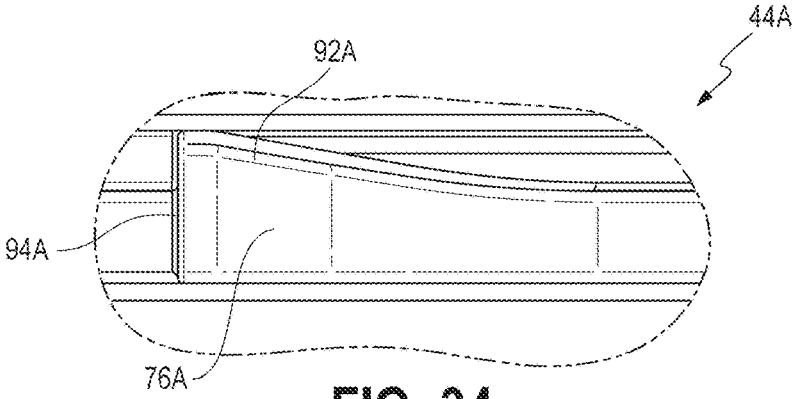
FIG. 34

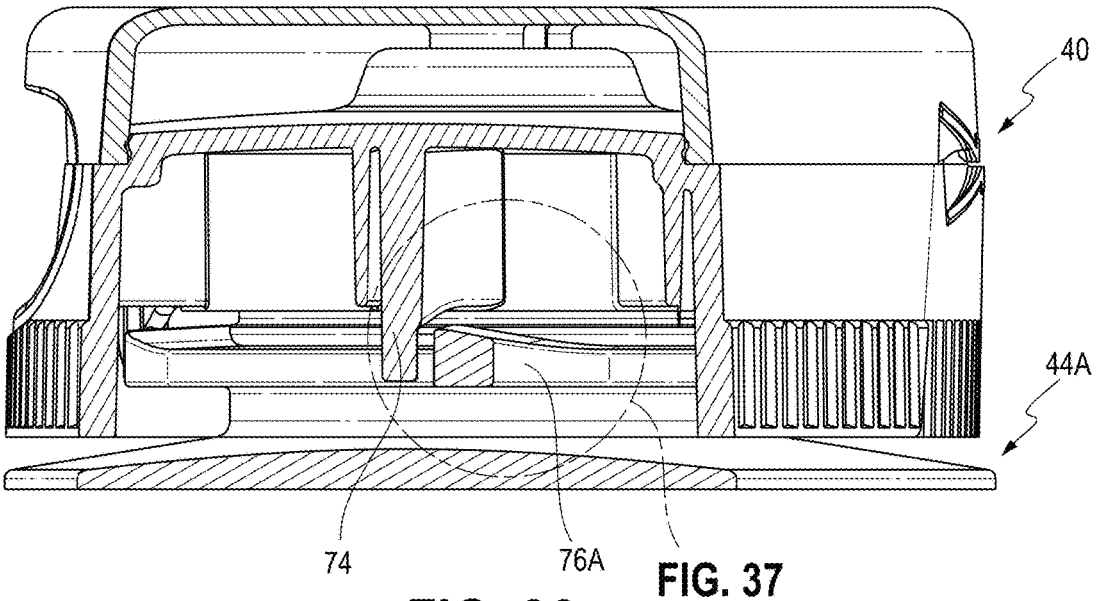
FIG. 36
FIG. 37
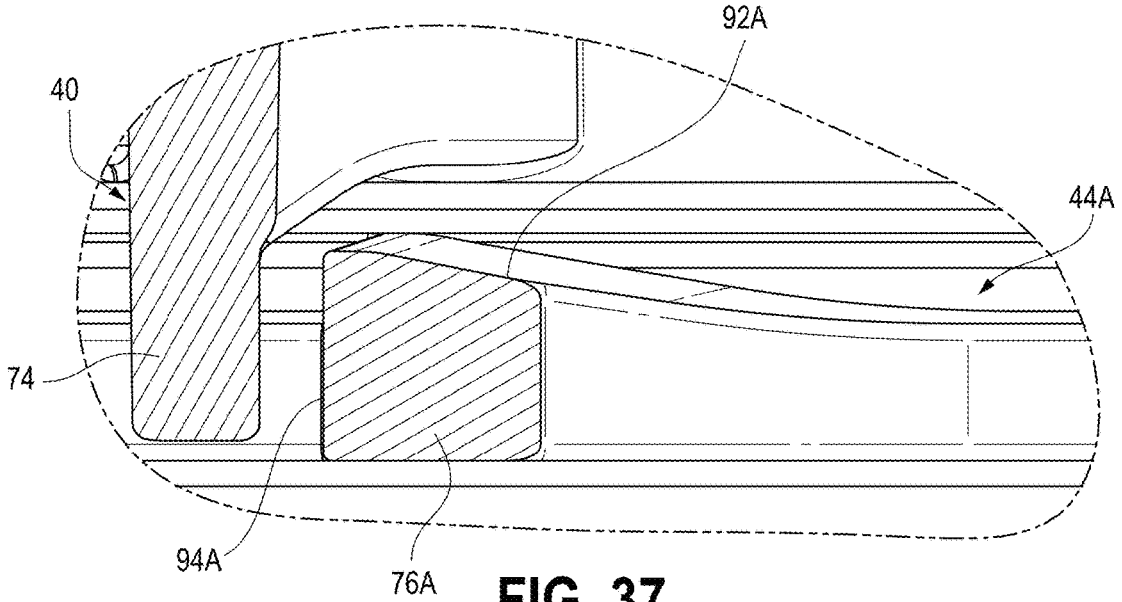
FIG. 37

CLOSURE, CONTAINER, AND ASSEMBLY THEREOF

PRIORITY

The present application claims priority from U.S. Provisional Patent Application No. 63/353,554, filed on Jun. 18, 2022, the entire contents of which is incorporated herein by reference.

TECHNICAL FIELD

The present invention relates generally to a closure for use with a container of a substance and an assembly of the closure and the container.

BACKGROUND OF THE INVENTION

Technical Problems Posed by the Prior Art

Closures are employed to selectively prevent or permit communication of a substance between the interior and the exterior of a container (e.g., flexible pouch, rigid bottle, machine, dispensing equipment, containment system, etc.) through an opening in the container. Various fluent and non-fluent substances (including lotions, creams, food items, granules, liquids, powders, small articles, etc.) may be packaged in a container. A typical closure includes a (1) body (e.g., screw or snap-fit base, pouch fitment, structure, etc.) located at an opening to the container interior, and (2) a closing element (e.g., a lid, cover, overcap, etc.).

The closure body can typically be either (1) a separate structure that (a) can be attached at such a container opening, and (b) defines at least one access passage through the body for communicating through such a container opening with the interior of such a container, or (2) an integral structure that is a unitary portion of such a container and that defines at least one access passage through the integral structure such that the access passage functions as the opening, per se, to the container.

The closing element typically accommodates movement relative to the body access passage between (1) a closed position or condition occluding the access passage, and (2) an open position or condition at least partially exposing the access passage. Some closures may include additional elements (e.g., tamper-evident features, silicone valves, locking elements, seals, etc.).

A closure specifically designed for dispensing a fluent substance may be described as a dispensing closure. Various fluent materials or substances (including oils, lotions, creams, gels, liquids, food items, granules, powders, etc.) may be packaged in a rigid, flexible, or collapsible container having a dispensing closure that can be opened and closed. A flexible container may be pressurized by a user to force the fluent substance from the container and through the closure body to dispense the fluent substance at a target region or onto a target surface area. The container with the closure mounted thereon, and the contents stored therein, may be characterized as a "package."

With some such dispensing closures, an annular foil membrane or "liner" may be disposed across a lower portion of the closure and the container open end and welded to seal the closure and container together to prevent their disassembly or adulteration of a fluent product stored within the container. Such a liner typically includes a composite structure of one or more thermoplastic coatings on both surfaces of an aluminum substrate which may be subjected to an induction heating process to melt the thermoplastic coating or coatings to establish a bond between the container and closure assembly. Such sealed closures and container assemblies may typically be employed in a retail or fast food type environment. While the liner or seal may adequately protect the assembly from tampering, the inventors of the present invention have found that some liners having a metal component (e.g., aluminum), used on a dispensing closure and container assembly, may prove difficult to recycle in some recycling streams.

The inventors of the present invention have determined that it would be advantageous to provide an improved closure and assembly of a closure and container having adequate sealing or attachment properties without any metallic liner. In particular, the inventors have discovered that this innovative closure and closure assembly design provides advantages not heretofore contemplated in the packaging industry or suggested by the prior art.

The inventors of the present invention have determined that it would be desirable to provide, at least for some applications, an improved closure and assembly thereof with a container that has improved retention torque over the prior art.

The inventors of the present invention have also found that it would be desirable to provide, at least for some applications, an improved closure and assembly thereof with a container that can be manufactured and/or assembled at a relatively low cost, and can accommodate manufacture by means of efficient, high-speed, large-volume techniques, and that can facilitate the minimization of secondary assembly operations and plastic part weight.

The inventors of the present invention have also determined that it would be desirable to provide, at least for some applications, a closure that is made from the same polymer as the container upon which it is installed to achieve mono material package recyclability.

The inventors of the present invention have discovered how to provide such an improved closure and container that include novel, advantageous features not heretofore taught or contemplated by the prior art, and which can accommodate designs having one or more of the above-discussed benefits or features.

SUMMARY OF THE INVENTION

According to broad aspects of one form of the present invention, a closure is provided for use in restricting access to a substance that may be stored within a container of the type having an opening and at least one laterally extending flange located laterally outwardly of the opening. The closure includes a body for being located at the opening of the container. The body has a deck defining an interior side and an exterior side and a central axis extending between the interior and the exterior sides. The deck includes at least one orifice communicating between the interior side and the exterior side. The body further includes an internal wall depending from the deck with means for attaching the closure to the container, and the body has at least one torque rib extending therefrom for confronting the at least one laterally extending flange of the container to inhibit relative rotation between the body and the container. The at least one torque rib is non-planar.

In one form of the present invention, the body further includes a skirt depending from the deck and surrounding the internal wall. The at least one torque rib extends from at least one of the internal wall and/or the skirt.

In another form of the present invention, the closure further includes at least one reinforcing rib extending between the internal wall and the skirt, wherein the at least one torque rib extends transversely from the at least one reinforcing rib.

In still another form of the present invention, the at least one torque rib extends axially inwardly of the at least one reinforcing rib.

According to another form of the present invention, the at least one reinforcing rib is planar and extends radially relative to the central axis of the closure body.

According to one preferred form of the present invention, the closure body includes a plurality of torque ribs, wherein, in an assembled configuration with the container, the body is configured to resist rotation relative to the container when subjected to a torque below about 40 inch-pounds (4.5 N-m).

According to one even more preferred form of the present invention, the closure body includes a plurality of torque ribs, wherein, in an assembled configuration with the container, the body is configured to resist rotation relative to the container when subjected to a torque below about 60 inch-pounds (6.8 N-m).

According to another aspect of the present invention, the at least one torque rib defines a laterally outward side facing away from the central axis and a laterally inward side facing toward the central axis, and the laterally outward side includes a first triangular projection.

According to another form of the present invention, the at least one torque rib defines a laterally outward side facing away from the central axis and a laterally inward side facing toward the central axis, and the laterally inward side includes a second triangular projection. Preferably, the second triangular projection is oppositely facing on the torque rib relative to the first triangular projection.

In one form of the present invention, the first triangular projection has a first distal tip defining a first interior angle, the second triangular projection has a second distal tip defining a second interior angle, and the second interior angle is greater than the first interior angle.

In still another preferred form of the present invention, the attachment means on the internal wall includes at least one screw thread for mating with at least one screw thread on the container.

In another form of the present invention, the closure includes a lid connected to the body, the lid being movable between i) a closed position occluding the at least one orifice, and ii) an open position exposing the at least one orifice to permit communication of a substance through the body.

According to yet another form of the present invention, the closure is provided in combination with a container for a fluent substance, the container having an opening and at least one laterally extending flange located laterally outwardly of the opening.

In another form of the present invention, the at least one laterally extending flange of the container is fin shaped and defines a flat end face for confronting the at least one torque rib of the closure body. Preferably, the at least one laterally extending flange further defines an axially extending ramp proximate to the flat end face.

In one preferred form of the present invention, the closure and container combination includes a plurality of torque ribs and a plurality of laterally extending flanges wherein, in an assembled condition of the closure and the container, the body is configured to resist rotation relative to the container when subjected to a torque up to about 40 inch-pounds (4.5 N-m).

In one more preferred form of the present invention, the closure and container combination includes a plurality of torque ribs and a plurality of laterally extending flanges wherein, in an assembled condition of the closure and the container, the body is configured to resist rotation relative to the container when subjected to a torque up to about 60 inch-pounds (6.8 N-m).

In another preferred form of the present invention, the closure includes a plurality of torque ribs, wherein the body is configured to move from an unassembled configuration with the container into an assembled configuration with the container when subjected to a torque not exceeding about 20 inch-pounds (2.25 N-m). More preferably, the body is configured to move from an unassembled configuration with the container into an assembled configuration with the container when subjected to a torque not exceeding about 16 inch-pounds (1.8 N-m).

According to a broad form of the present invention, the closure is provided in combination with container of a fluent substance, wherein the closure, the container, and the fluent substance together define a package.

It should be appreciated that the invention may include any or all of the above-described features, include only one of the above-described features, more than one of the above-described features, and any combination of the above-described features. Furthermore, other objects, features and advantages of the invention will become apparent from a review of the entire specification including the appended claims and drawings.

BRIEF DESCRIPTION OF THE DRAWINGS

FIG. 1 shows the closure in a closed position with the lid occluding the orifice;

FIG. 2 shows the closure and container in an assembled configuration;

FIG. 9 is a left side elevational view of only the fragmentary portion of the container of FIG. 1, and FIG. 9 is rotated 90 degrees clockwise relative to the left side elevation view;

FIG. 10 is a top plan view of the container of FIG. 9;

FIG. 18 is another reduced size, front elevational view of the closure and container assembly of FIG. 2;

FIG. 19 is a cross-sectional view of the closure and container assembly of FIG. 2, taken along plane 19-19 in FIG. 18;

FIG. 24 is a top plan view of the cross-sectioned closure and container assembly of FIG. 22;

FIG. 25 is a cross-sectional view of the closure and container assembly of FIG. 2, taken along plane 25-25 in FIG. 24;

FIG. 28 is a top plan view of the cross-sectioned closure and container assembly of FIG. 19;

FIG. 29 is a cross-sectional view of the closure and container assembly of FIG. 2, taken along plane 29-29 in FIG. 28;

FIG. 31 shows the skirt and lid portions of the closure omitted;

FIG. 32 is a fragmentary, top plan view of a portion of a second embodiment of a container according to the present invention;

FIG. 33 is a front elevational view of the container FIG. 32;

FIG. 34 is a greatly enlarged, detailed view of the circled portion of the container in FIG. 33;

FIG. 35 shows the skirt and lid portions of the closure omitted;

FIG. 36 is a cross-sectional view of the closure and container assembly of FIG. 35, taken along a vertical plane extending through the torque rib of the closure and a container flange; and FIG. 37 is a greatly enlarged, detailed view of the circled portion of the closure and container assembly in FIG. 36.

DESCRIPTION OF THE PREFERRED EMBODIMENTS

While this invention is susceptible of embodiment in many different forms, this specification and the accompanying drawings disclose only specific forms as examples of the invention. The invention is not intended to be limited only to the embodiments so described, and the scope of the invention will be pointed out in the appended claims.

Figure 1:
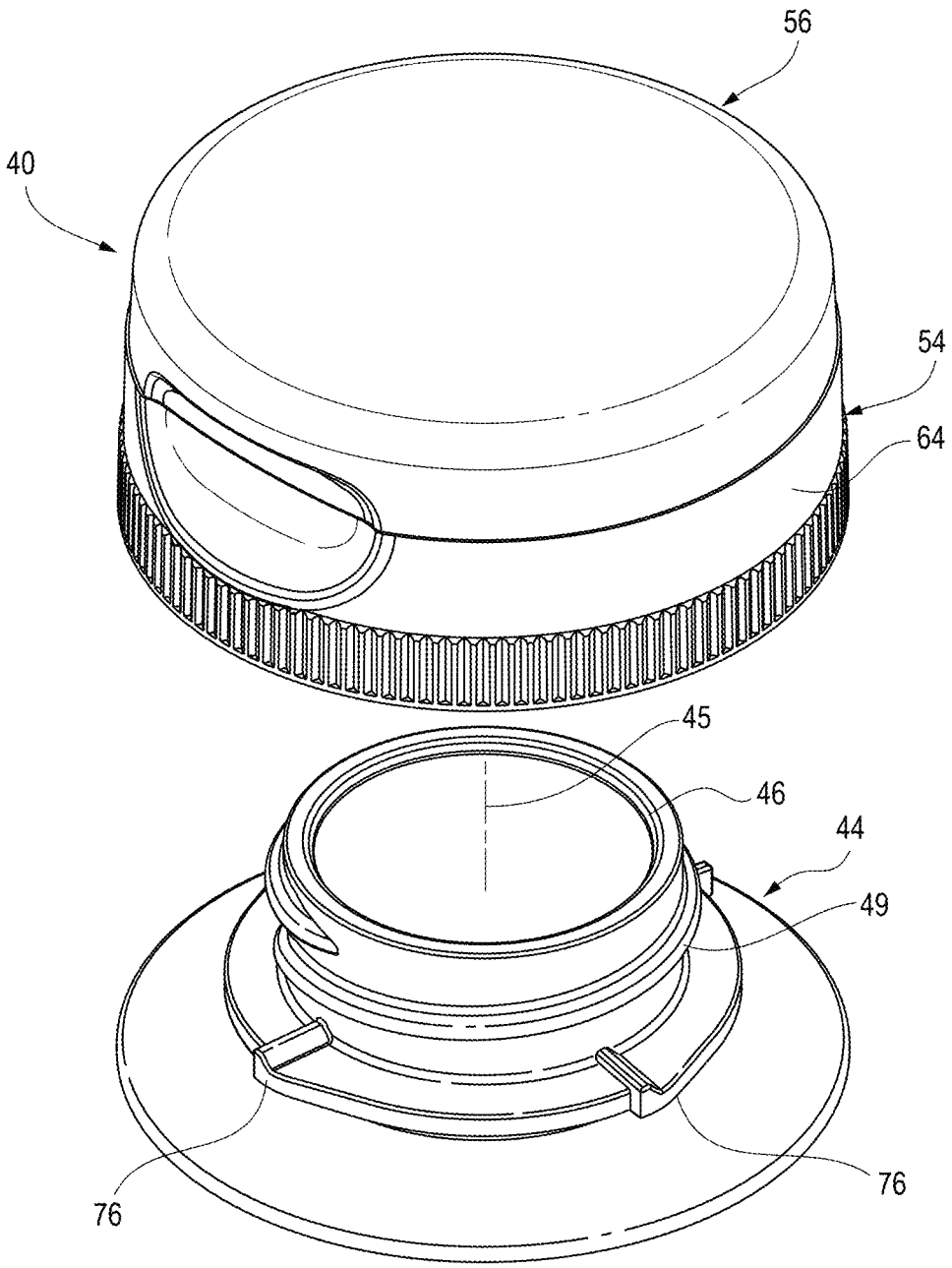
FIG. 1 is an exploded, isometric view from above of a closure and fragmentary upper portion of a container according to the present invention.

For ease of description, many figures illustrating the invention show an embodiment of a dispensing closure (or simply referred to herein as a "closure") 40 in the typical orientation that the closure 40 would have when located at the opening of a container 44 such as an upright bottle, and terms such as "inward", "outward", "upper", "lower", "axial", "radial", "lateral", etc., are used with reference to this orientation. The term "axially inward" is to be understood as in the direction along a central axis 45 (visible in FIGS. 1 and 5) of the closure 40 (and this axis is shared and coincident with the central axis of the container 44 when assembled with the closure 40), toward the interior of the container 44 when the closure 40 is mounted atop the opening of the container 44, as is illustrated in FIG. 1. The term "axially outward" is to be understood as in the opposite direction along the central axis 45, away from the interior of the container 44. The term "radially inward" is to be understood as in the radial direction toward the central axis 45. The term "radially outward" is to be understood as in the radial direction away from the central axis 45. The term "laterally inward" is to be understood as in a direction toward the central axis 45, in a plane normal or orthogonal to the central axis 45. The term "laterally outward" is to be understood as in a direction away from the central axis 45, in a plane normal or orthogonal to the central axis 45. It will be understood, however, that the closure and container of this invention may be manufactured, stored, transported, used, and sold in an orientation other than the specific orientations described and illustrated herein.

The closure of this invention is especially suitable for use with a variety of conventional or special containers, the details of which, although not fully illustrated or described, would be apparent to those having skill in the art and an understanding of such containers. The particular container illustrated is not intended to limit the broadest form of the present invention. It will also be understood by those of ordinary skill that novel and non-obvious inventive aspects are embodied in the described closure alone.

The closure described herein is especially suitable for use in dispensing a fluent substance that is a non-Newtonian, shear thinning substance such as ketchup or mayonnaise. Such dispensed fluent substances may be, for example, food additives, a personal care product, an industrial product, a household product, or other types of products. Such substances may be for internal or external use by humans or animals, or for other uses (e.g., activities involving medicine, commercial or household maintenance, agriculture, manufacturing, etc.).

The illustrated preferred embodiment of the closure 40 of the present invention has the form of a self-contained article or part that is configured to be (i) selectively placed at an opening of a container 44 (such as at the opening 46 of the container 44 in FIG. 1) and (ii) actuated to dispense a fluent substance from the interior of the container 44. The illustrated container 44 (which is shown a fragmentary upper portion or neck of a larger structure) has the form of a bottle that would typically contain the fluent substance. The fluent substance to be dispensed from the closure 40 is not illustrated in the figures because the substance may take a variety of forms. The closure 40 is mounted to the container 44 with threads 48 (visible in FIG. 5) for mating with or engaging threads 49 (visible in FIG. 5) on the container 44. Closure mounting features or attachment means other than mating threads could be used, such as snap-fit beads and grooves, toggle clamps, friction fittings, locks, adhesives, welding, etc.

It will be understood that the container 44 may be any conventional type, such as a collapsible, flexible pouch, or may be a generally rigid bottle that has somewhat flexible, resilient walls. The container 44, or a portion thereof, may be made from a material suitable for the intended application. For example, the container 44 may be a hard plastic spout or fitment for being sealed within a pouch made from a thin, flexible material (wherein such a material could be a polyethylene terephthalate (PET) film or a polyethylene film and/or an aluminum foil). Alternatively, a more rigid container 44 (e.g., a bottle) could be made from a thicker, less flexible material such as molded polyethylene, polypropylene, polyethylene terephthalate, polyvinylchloride, glass, metal, or other materials.

It is contemplated that typically, after the closure manufacturer would make the closure 40 (e.g., by molding its components from a thermoplastic polymer), the manufacturer will then ship the closure 40 to a filler facility at another location where the container 44 would be filled with a product, assembled with the closure 40, and sealed in the form of a package that would be encountered by a customer or user.

Figure 5:
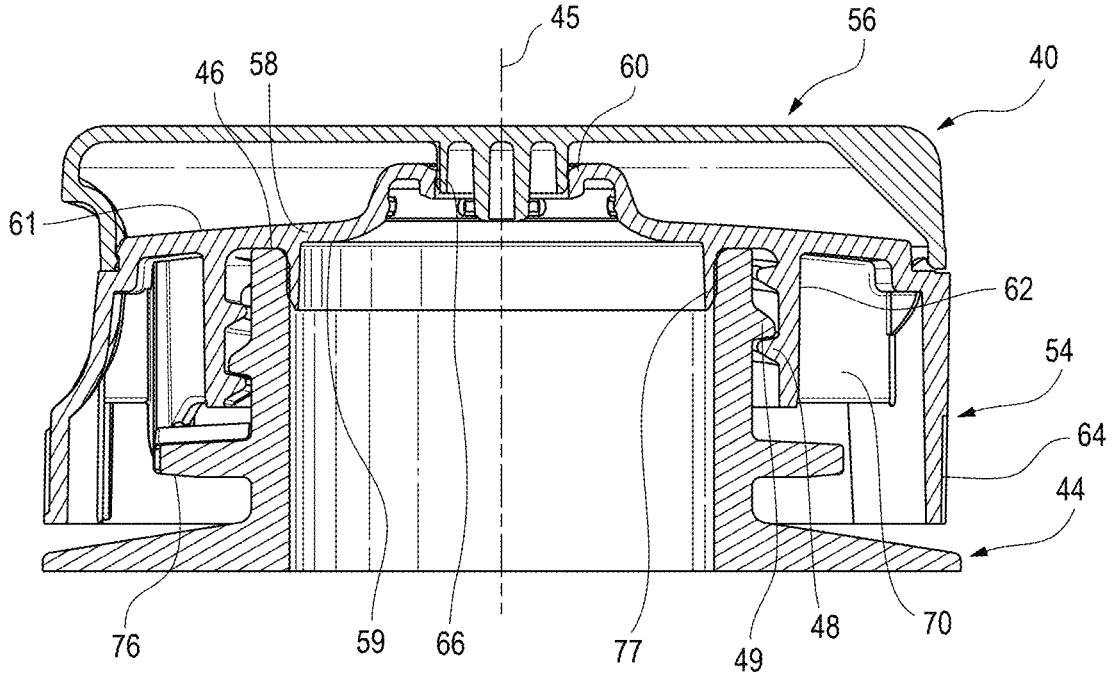
FIG. 5 is a cross-sectional view of the closure and container assembly of FIG. 2, taken along plane 5-5 in FIG. 3.

With reference to the accompanying FIG. 5, the illustrated preferred embodiment of the closure 40 of the present invention includes a generally hollow base or body 54 and a lid 56 that is connected to the body 54. The body 54 includes a top end or deck 58 which defines an interior side 59 facing the interior of the container 44 (i.e., axially inward) and an exterior side 61 facing the ambient environment (i.e., axially outward). The deck 58 further includes a dispensing orifice, or simply "orifice" 60 therein permitting communication between the sides 59 and 61. A first wall or internal wall 62 extends axially inwardly or downwardly from the deck 58. The internal wall 62 includes the aforementioned internal threads 48 for receiving external threads 49 of the container 44 to secure the body 54 to the container 44. An outer wall or skirt 64 surrounds the internal wall 62 and also extends axially inwardly or downwardly from the deck 58. It will be understood that the body 54 may have other attachment means with the container 44, as discussed above, located on the internal wall 62, the skirt 64, or any other portion of the body 54 to secure the closure body 54 with the container 44.

Figure 27:
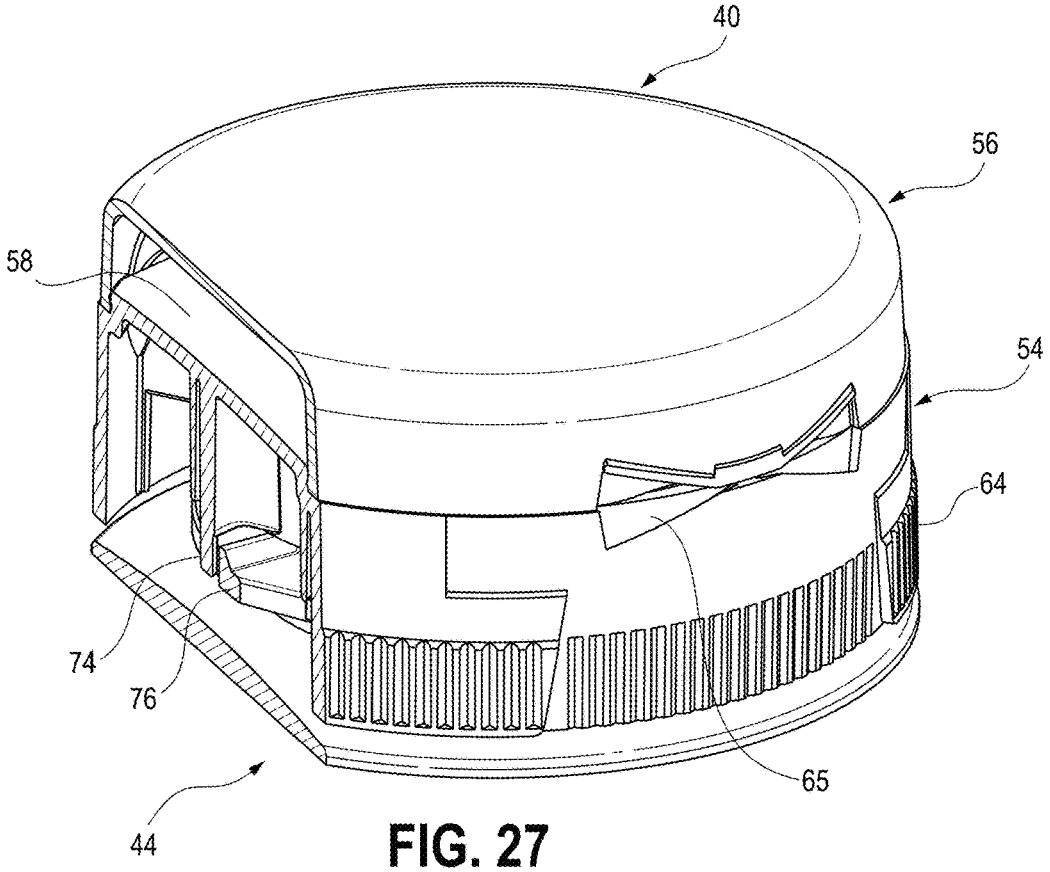
FIG. 27 is an isometric view, from above, of the cross-sectioned closure and container assembly of FIG. 25.
Figure 30:
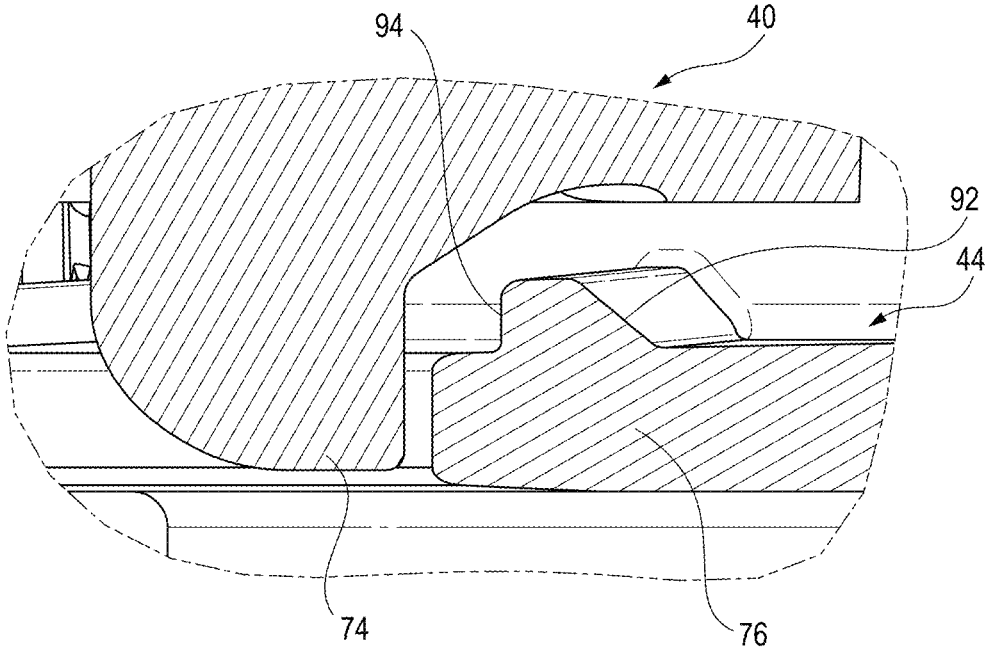
FIG. 30 is a greatly enlarged, detailed view of the circled portion of the closure and container assembly in FIG. 29.
Figure 31:
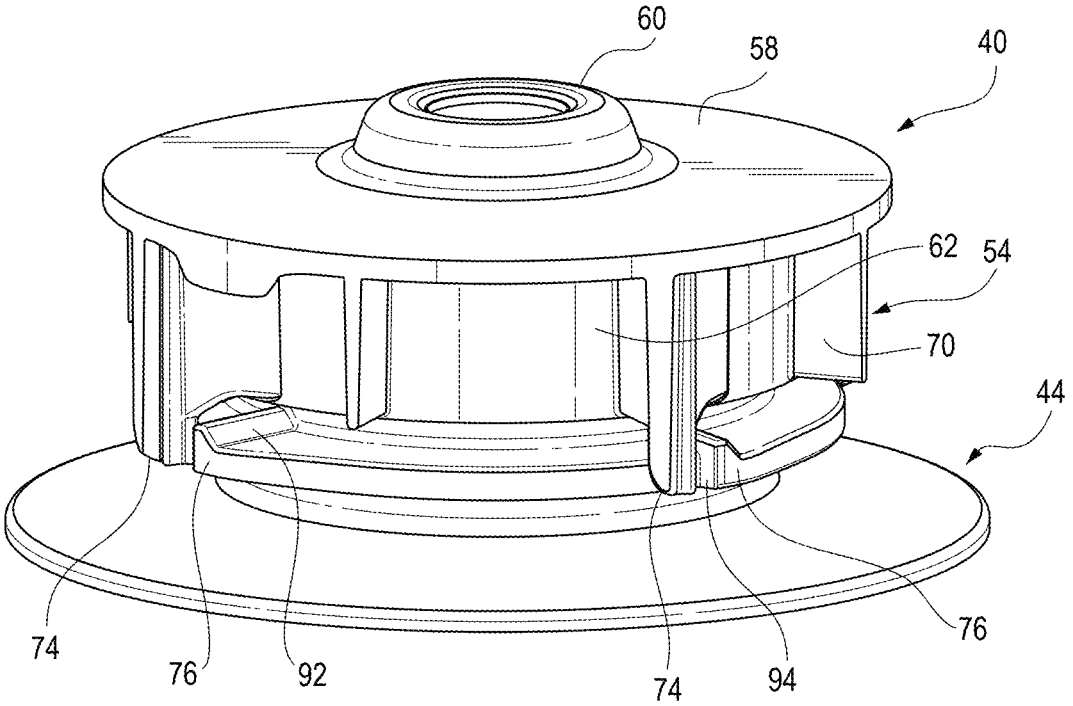
FIG. 31 is a simplified, isometric view of the closure and container assembly of FIG. 2.

With reference now to FIG. 27, the lid 56 is connected to the body 54 by a hinge 65. The hinge 65 is molded unitarily with the lid 56 the closure body 54 near the deck 58 so as to accommodate movement of the lid 56 between an open position or condition exposing the orifice 60, and the closed position or condition occluding the orifice 60 of the closure body 54. The hinge 65 may be of any suitable conventional or special design. For example, the hinge 65 illustrated in the figures may be of a conventional snap-action type such as described in the U.S. Pat. No. 5,356,017 or 5,642,824, the details of which form no part of the broadest form of the present invention. The hinge 65 could also be a non-snap-action type, including a strap or tether. The lid 56 and/or the body 54 may have latching means such as snap fit beads, locks, tabs, etc. to secure the lid 56 in the closed position atop the body 54. The lid 56 may mated with the body 54 in a wholly removable manner, such as by mating screw threads, friction or snap fit beads, etc. The lid 56 may be omitted altogether in some applications.

Referring again to FIG. 5, the lid 56 includes a resilient plug seal 66 for sealing or occluding the orifice 60 when the lid 56 is in its closed position atop the body 54. The deck 58 surrounding the orifice 60 and/or the lid plug seal 66 are sufficiently flexible to accommodate elastic deformation to establish a leak-tight seal therebetween. The orifice 60 is circular and centered on the central axis 45. However, it will be understood that, in some applications, the orifice 60 and its corresponding plug 66 of the lid 56 may have other shapes, such one or more slots and elongate plugs, a plurality of apertures and plugs, polygonal apertures and plugs, irregularly shaped apertures and plugs, etc.

Figure 6:
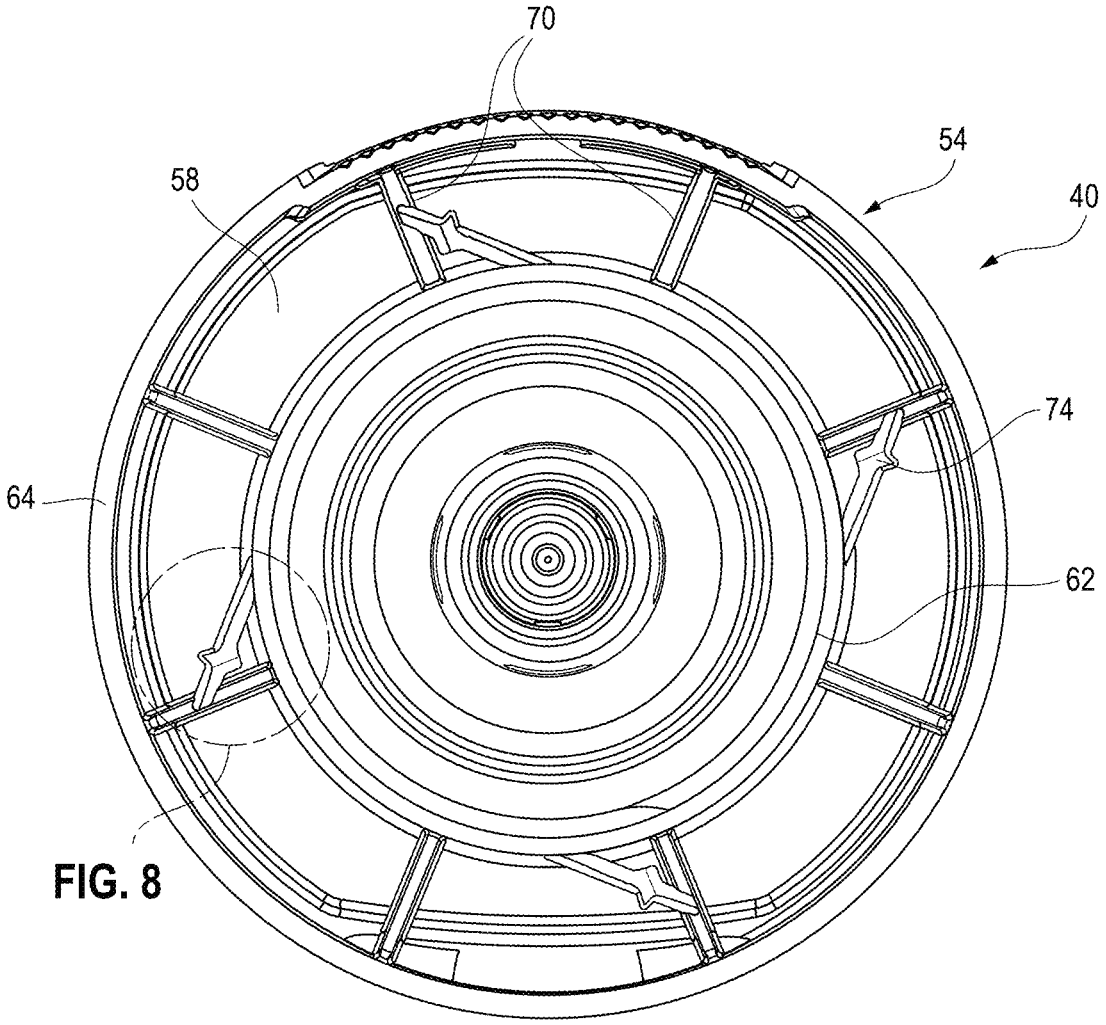
FIG. 6 is a bottom plan view of only the closure of FIG. 1.
Figure 7:
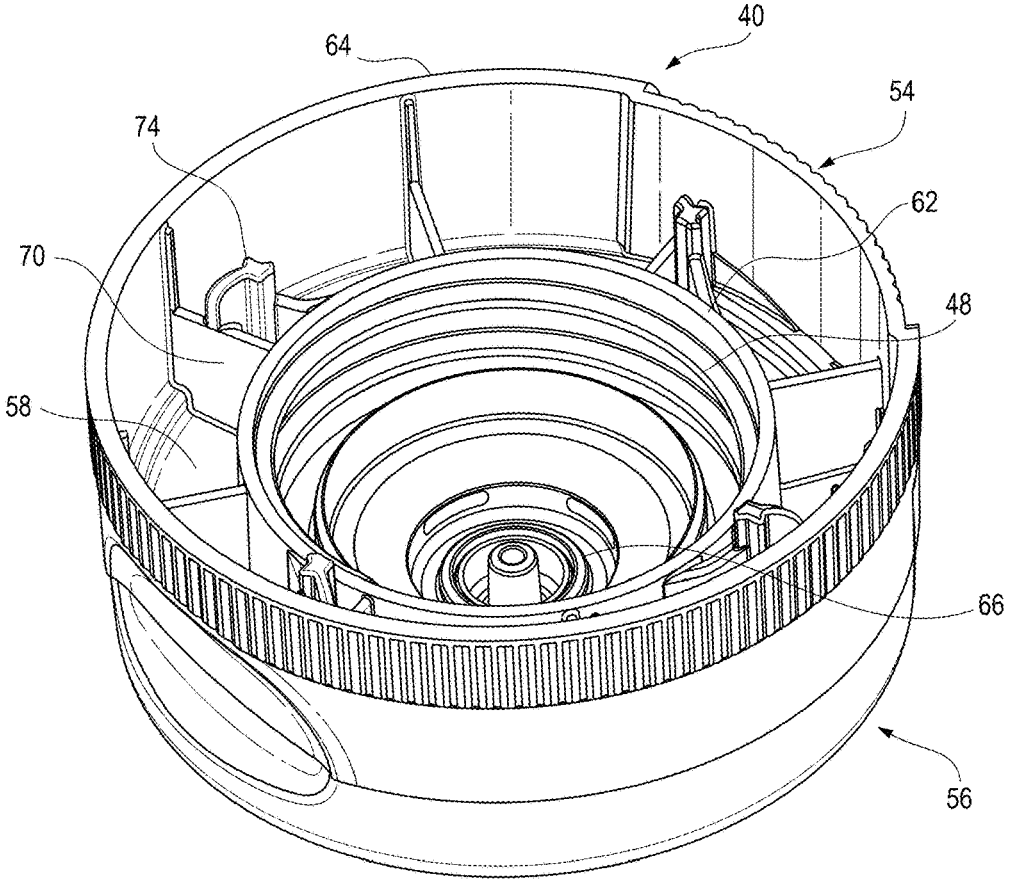
FIG. 7 is an isometric view, from below, of the closure of FIG. 6.
Figure 8:
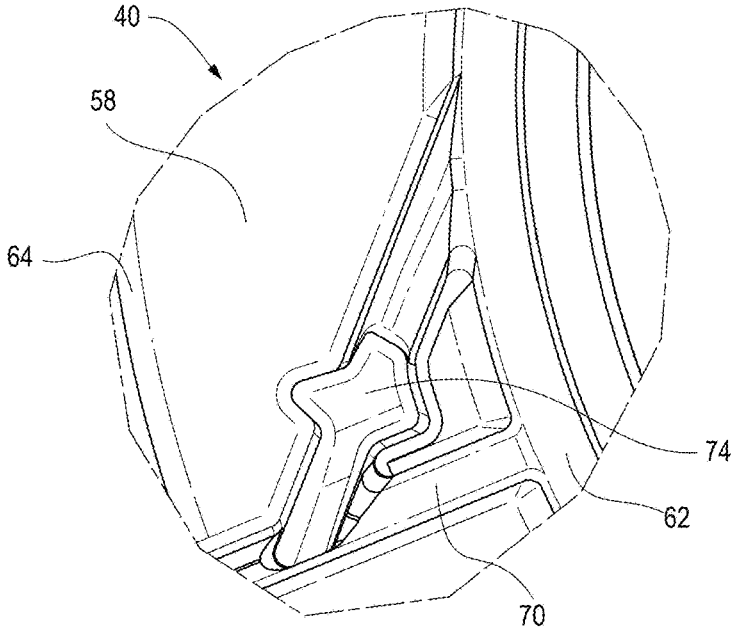
FIG. 8 is a greatly enlarged, detailed view of the circled portion of the closure in FIG. 6.
Figure 11:
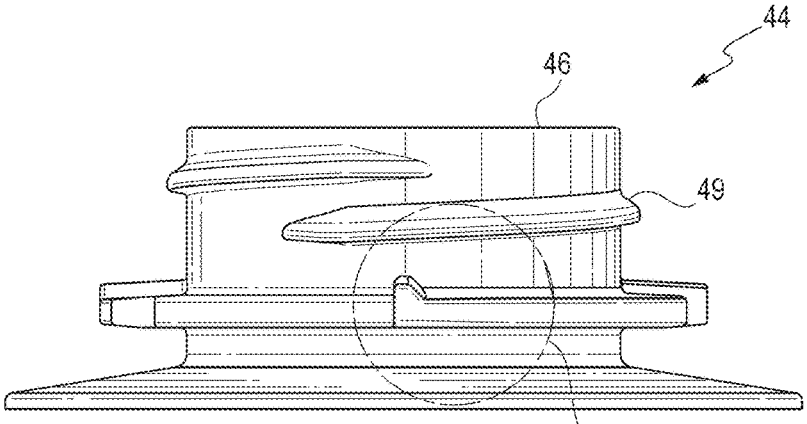
FIG. 11 is a front elevational view of the container of FIG. 9.
Figure 20:
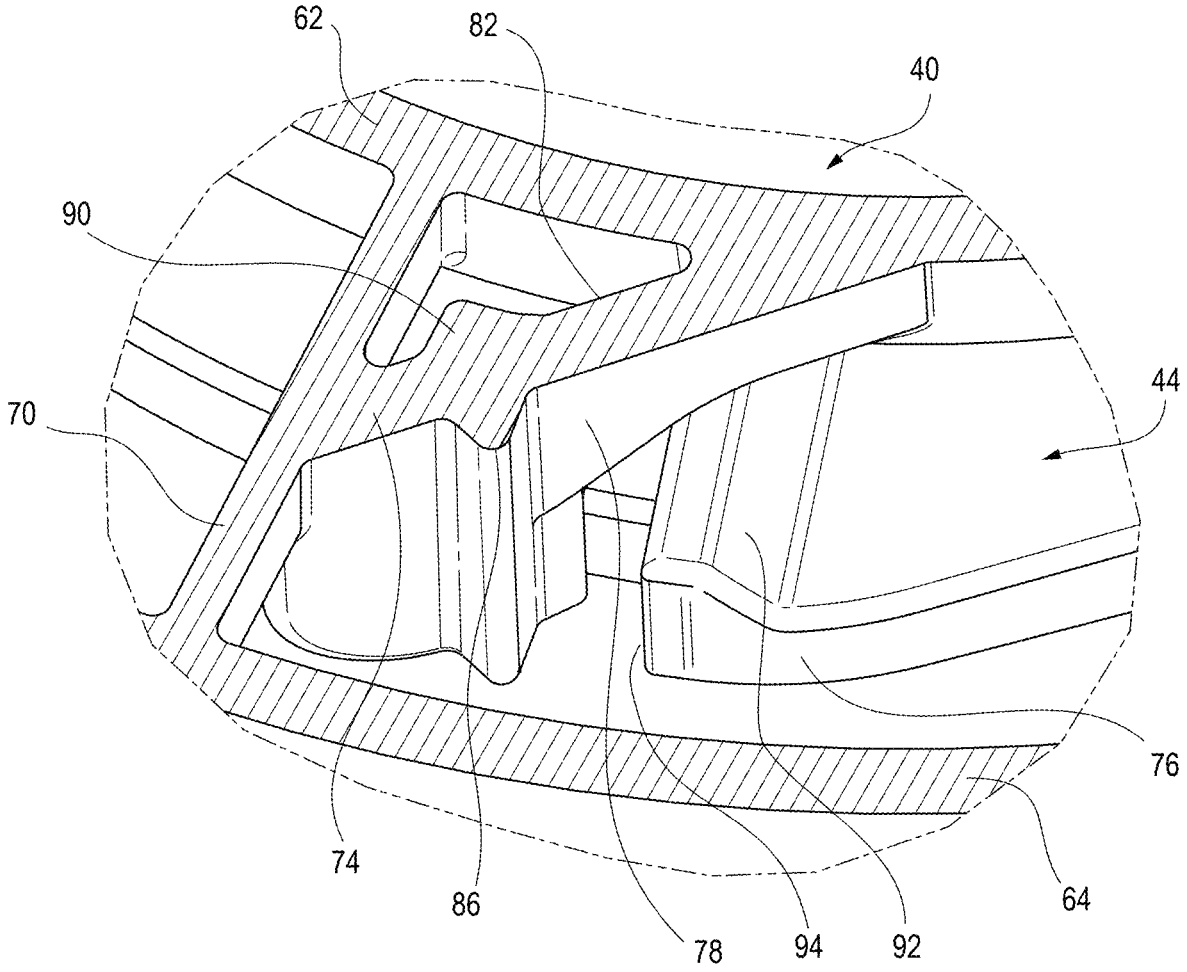
FIG. 20 is a greatly enlarged, detailed cross-sectional isometric view of the circled portion of the closure and container assembly in FIG. 19.
Figure 21:
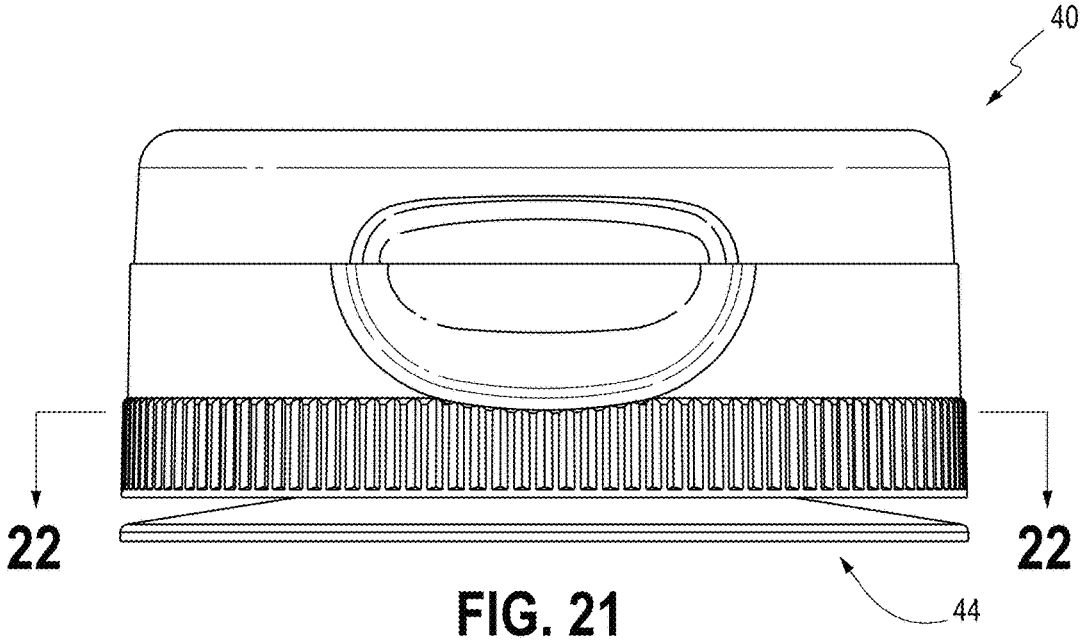
FIG. 21 is another reduced size, front elevational view of the closure and container assembly of FIG. 2.
Figure 22:
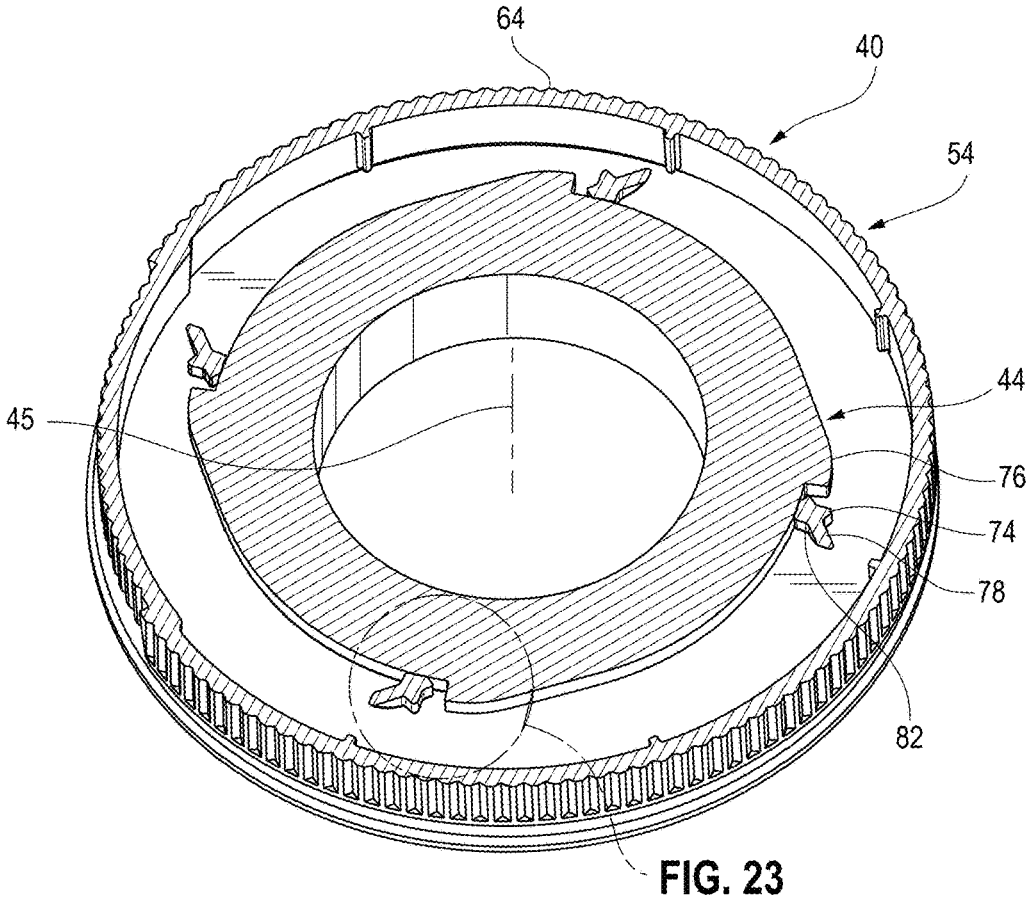
FIG. 22 is a cross-sectional, isometric view of the closure and container assembly of FIG. 2, taken along plane 22-22 in FIG. 21.

Referring now to FIG. 6, the body 54 includes a plurality of reinforcing ribs 70 extending radially between the skirt 64 and the internal wall 62. Each one of the reinforcing ribs 70 is generally planar and extends in a vertical plane extending through the central axis 45. The body 54 further includes a plurality of angled or transverse torque ribs 74, each one extending from a reinforcing rib 70 at an angle of about 45 degrees. As can be seen in FIGS. 8 and 20, each one of the torque ribs 74 is non-planar and has a configuration for providing substantially enhanced retention torque compared to prior art retention structures. The torque rib 74 functions to (i) non-destructively flex radially outwardly when the closure 40 is threaded or otherwise installed at the opening of the container 44 in one rotational direction about the central axis 45, and (ii) prevent or inhibit relative rotation between the closure 40 and the container 44 in the opposite direction about the central axis 45 after assembly or installation of the closure 40 with the container 44.

One or more torque ribs 74 of the closure 40 may cooperate with one or more flanges 76 (visible in FIGS. 1 and 20) extending laterally or laterally outwardly around the opening 46 of the container 44 to prevent or inhibit relative rotation between the closure 40 and the container 44 up to a threshold of about 40 inch-pounds (about 4.5 N-m) of torque. More preferably, the torque rib or ribs 74 may cooperate with one or more of the flanges 76 to prevent or inhibit relative rotation between the closure 40 and the container 44 up to a threshold of about 60 inch-pounds (about 6.8 N-m) of torque.

Referring next to FIG. 5, the closure body 54 includes circumferential plug seal wall 77 for sealing against the interior surface of the container opening 46. The plug seal wall 77 may have any shape to conform with the shape of the interior surface of the container opening 46. Alternatively, the plug seal wall 77 may have the form of a flange or crab's claw seal (not illustrated) for contacting the top or upper surface of the container 44. Other seal structures may be employed to establish a leak-tight seal between the container 44 and the closure 40.

Figure 16:
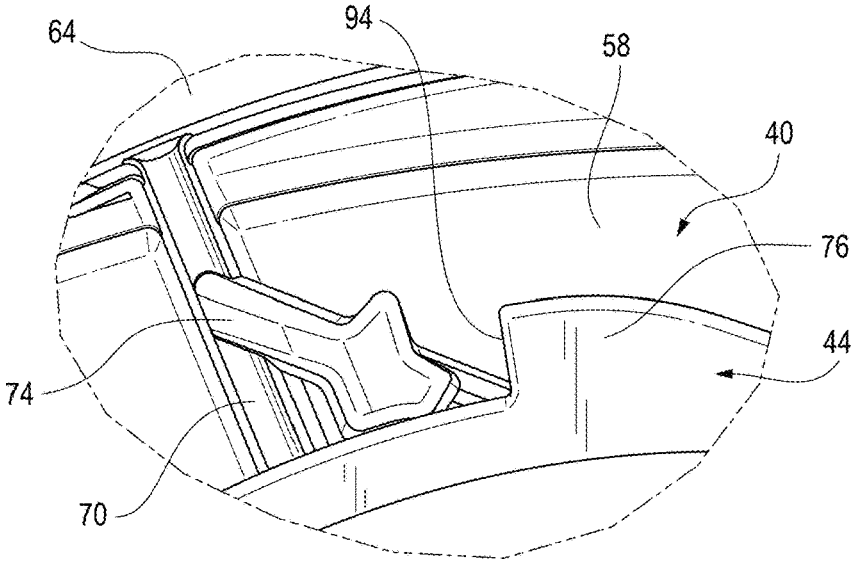
FIG. 16 is a greatly enlarged, detailed view of the circled portion of the closure and container assembly in FIG. 15.
Figure 17:
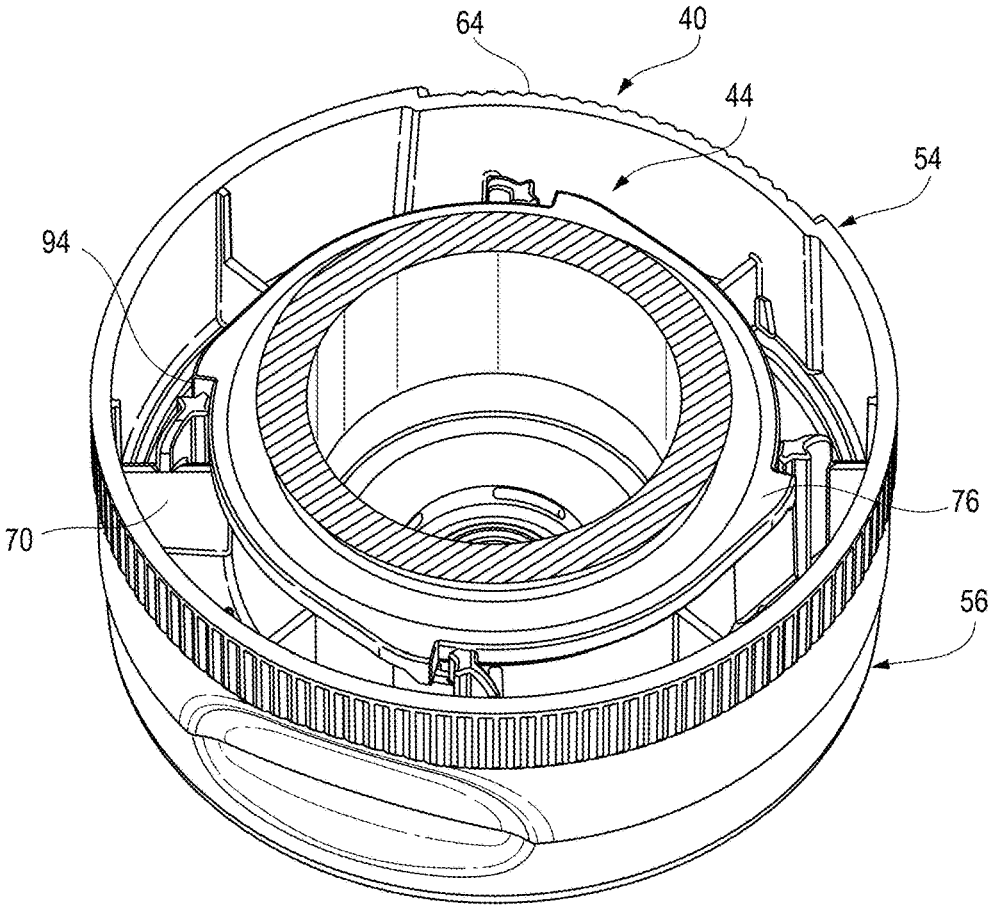
FIG. 17 is an isometric view, from below, of the cross-sectioned closure and container assembly of FIG. 15.
Figure 23:
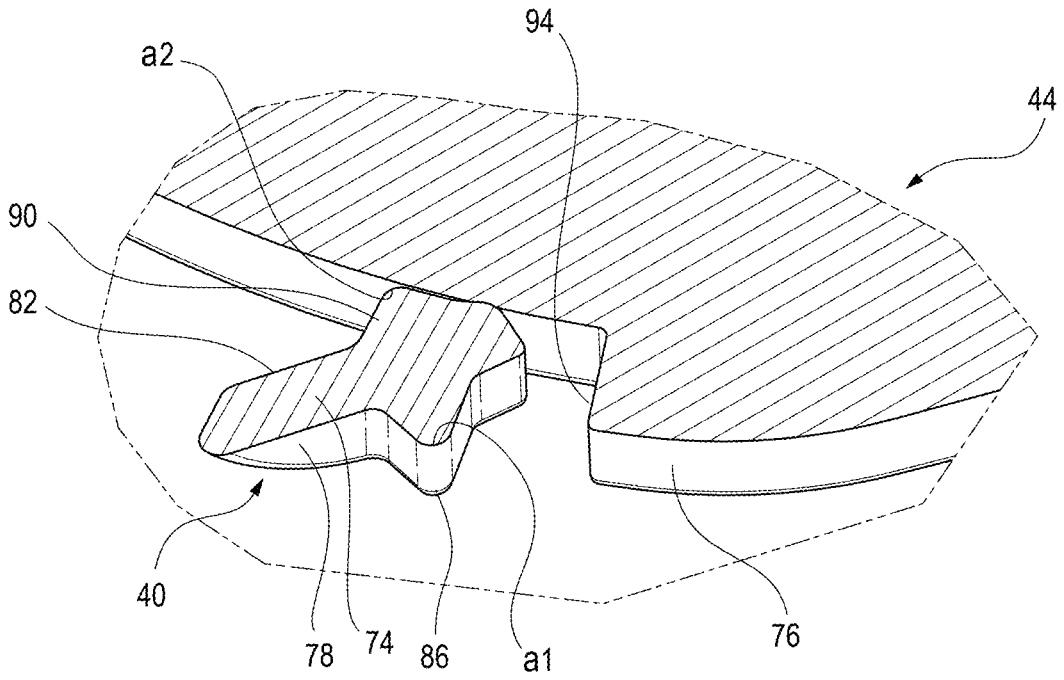
FIG. 23 is a greatly enlarged, detailed cross-sectional, isometric view of the circled portion of the closure and container assembly in FIG. 22.
Figure 26:
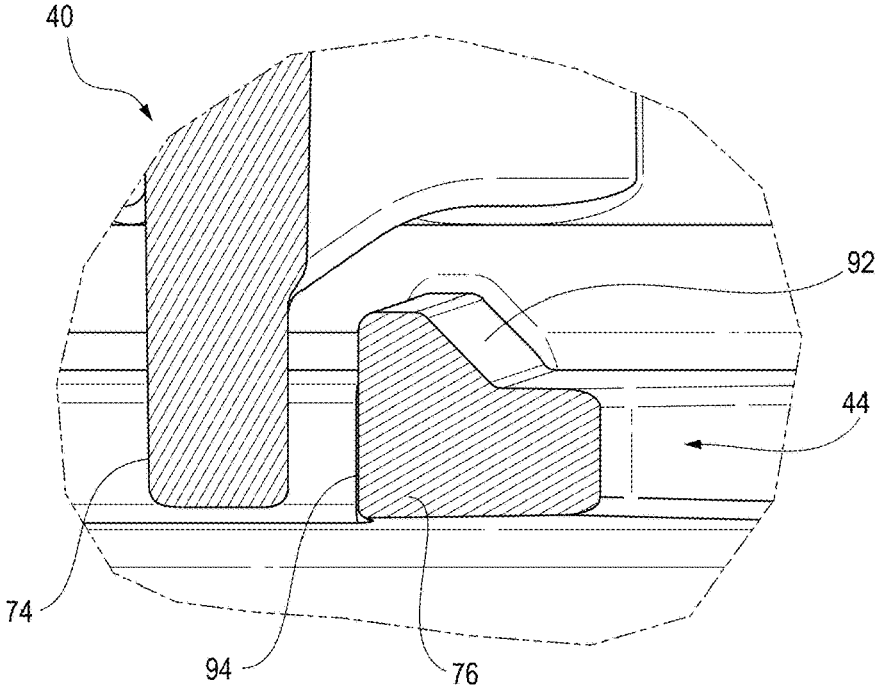
FIG. 26 is a greatly enlarged, detailed view of the circled portion of the closure and container assembly in FIG. 25.

Referring now to FIGS. 19 and 20, each torque rib 74 defines a laterally or radially outward side 78 facing away from the central axis 45 (visible in FIG. 19) and toward the skirt 64, and a laterally or radially inward side 82 facing toward the central axis 45 and toward the internal wall 62. Each torque rib 74 has a barbed or clubbed appearance when viewed in cross-section in a horizontal plane that is normal or perpendicular to the central axis 45 (as shown in FIGS. 16, 19, and 20). The torque rib laterally outward side 78 includes a first triangular projection 86 having a first distal point defining a first interior angle $\alpha 1$ (designated in FIG. 23 only). The torque rib laterally inward side 82 includes a second triangular projection 90 having a second distal point defining a second interior angle $\alpha 2$ (designated in FIG. 23 only). The second interior angle $\alpha 2$ is significantly larger than the first interior angle $\alpha 1$. As can also be seen in FIG. 20, at least a portion of each torque rib 74 extends axially inwardly (below) the associated reinforcing rib 70 in a cantilevered fashion for opposing (facing) the nearest flange 76 of the container 44 in the assembled configuration of the closure 40 and the container 44. While the illustrated preferred embodiment of the closure 40 includes the torque ribs 74 arranged to each extend from the internal wall 62 to one reinforcing rib 70 for improved strength and resistance to an opening torque applied to the assembled closure 40 and container 44, it will be understood that, in some non-preferred embodiments of the present invention (not illustrated), one or more of the torque ribs 74 may extend only from the internal wall 62, or only from the skirt 64, or only from the reinforcing rib 70. Alternatively, one or more of the torque ribs 74 may extend between the internal wall 62 and the skirt 64 without connecting with any reinforcing rib 70 or other structure of the body 54.

As will be discussed in greater detail hereinafter, the closure body 54 includes four torque ribs 74 for confronting four respective flanges 76 extending from the container 44. It will be understood that, in some applications, the closure body 54 may have only one torque rib 74 or any other number of torque ribs 74 as required for the application. Furthermore, it will be understood that, in some applications, the closure container 44 may have only one flange 76 or any other number of flanges 76 as required for the application.

Figure 12:
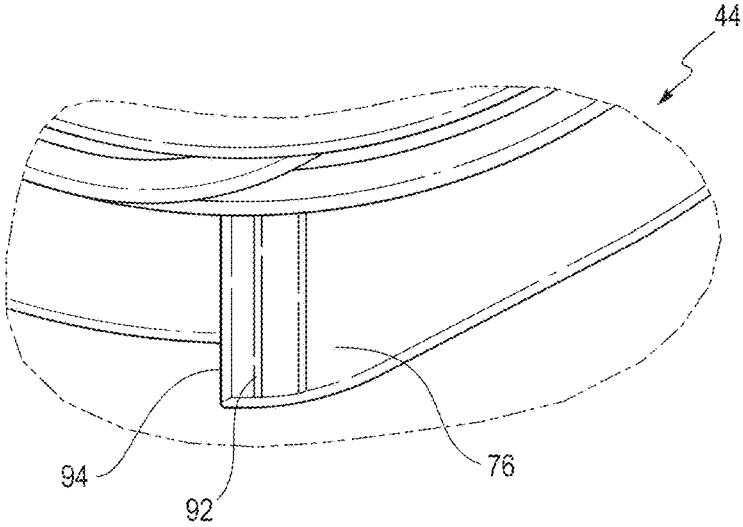
FIG. 12 is a greatly enlarged, detailed view of the circled portion of the container in FIG. 10.
Figure 13:
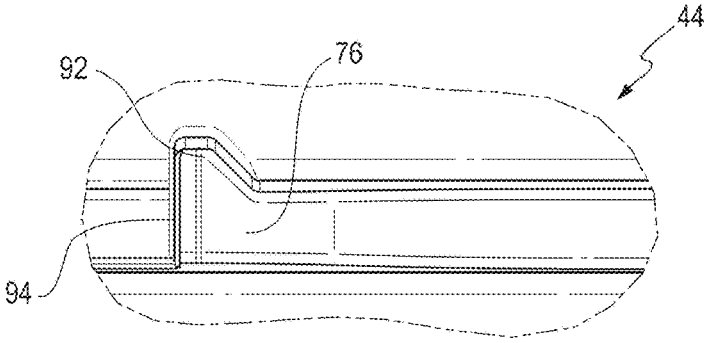
FIG. 13 is a greatly enlarged, detailed view of the circled portion of the container in FIG. 11.
Figure 14:
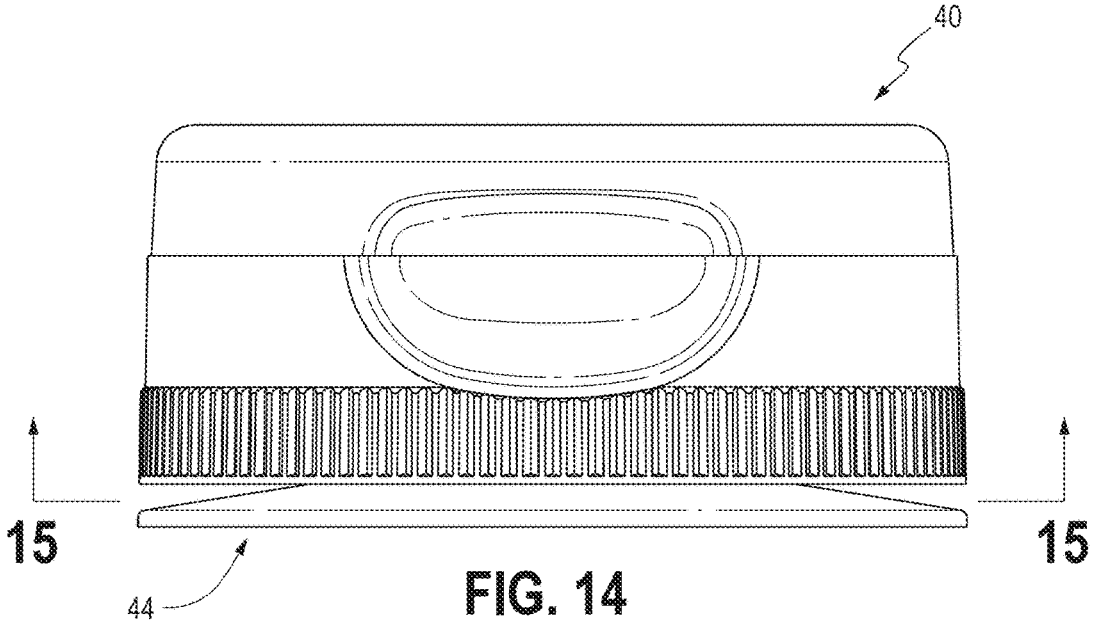
FIG. 14 is a reduced size, front elevational view of the closure and container assembly of FIG. 2.
Figure 15:
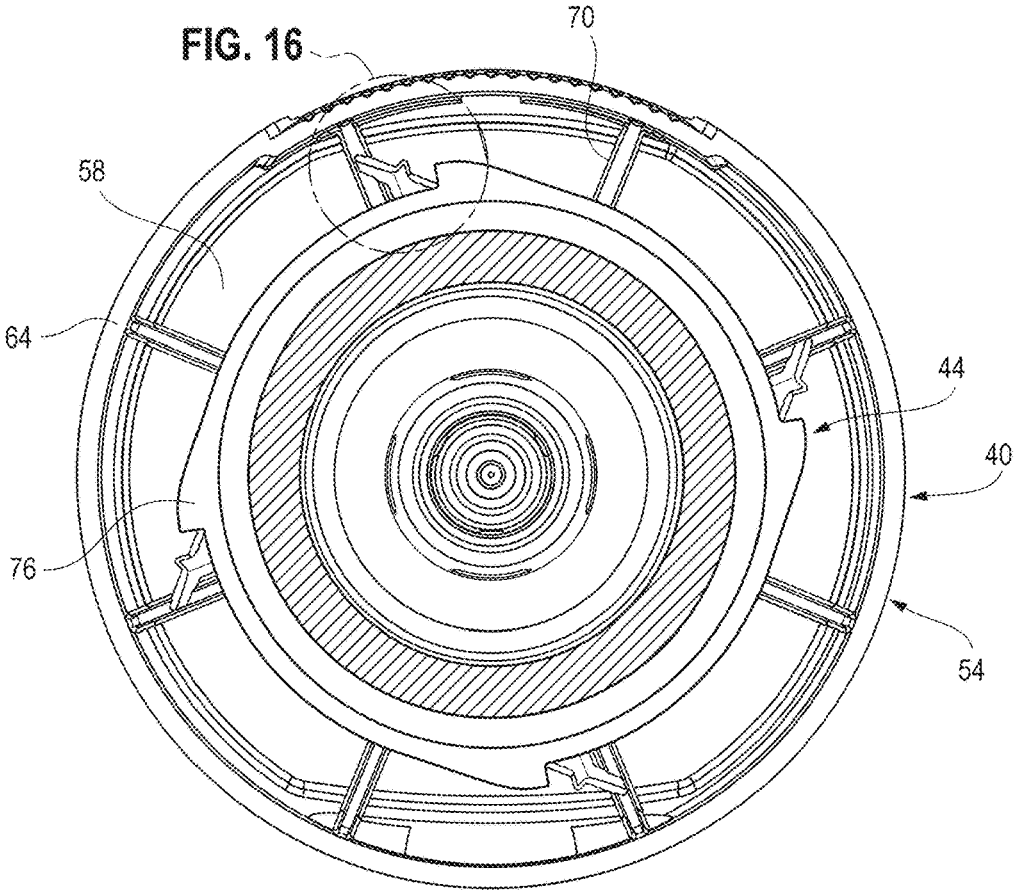
FIG. 15 is a cross-sectional view of the closure and container assembly of FIG. 2, taken along plane 15-15 in FIG. 14.

With reference now to FIGS. 10, 12, and 13, the preferred illustrated embodiment of the container 44 includes four laterally or radially extending flanges 76 that surround the opening 46 on the neck of the container 44, at a location that is axially inwardly (below) the location of the aforementioned threads 49. The flanges 76 function to permit the torque ribs 74 to pass non-destructively during initial installation or threading of the closure 40 in the clockwise direction relative to the container 44, and further function to prevent or inhibit unthreading of the closure 40 from the container 44 in the counterclockwise direction. Each one of the flanges 76 has a fin-shaped profile, when viewed in a plane that is normal to the central axis 45 (as viewed in FIGS. 10 and 12) and includes an axially outwardly extending ramp 92 and a substantially flat end face 94 to confront one of the torque ribs 74.

The inventors have found that providing the closure 40 and container 44 of the present invention provides a simple to manufacture closure design that prevents, or at least minimizes, the potential for a user to tamper with, or refill, an assembly of the closure 40 and the container 44. The inventors have further discovered that the assembly of the closure 40 and the container 44 may advantageously provide sufficiently high resistance to an opening torque so as to eliminate the need for a secondary seal or foil liner that would increase the cost and difficulty of the recyclability of the assembly. The inventors presently believe that the arrangement of the non-planar torque ribs 74 presents a novel face with a wedge shape to bite into the container 44 which flattens out under load to create even more interference when making contact with the container flanges 76. The closure 40 may be molded as a unitary structure and may thus be more easily manufactured and assembled, for a lower cost, than other prior art closures requiring secondary seals and/or additional retention components. Furthermore, the closure 40 and container 44 could be unitarily molded from a single resin identification code polymer for single stream recycling of the assembly.

The inventors have further found that the assembly of the closure 40 and the container 44 may advantageously be assembled with a relatively low installation torque, lower than about 20 inch-pounds (2.25 N-m), and more preferably about 16 inch-pounds (1.8 N-m), while also providing a sufficiently high resistance to an opening torque that is at least three times greater than the installation torque. Terms of approximation, such as "about", used herein with respect to torque values indicate a range of +/−5 inch-pounds (0.5 N-m).

The body 54 and the lid 56 are preferably formed or molded from a suitable thermoplastic material such as polypropylene or polyethylene. Other materials may be employed instead. It will be understood that in alternative designs (not illustrated), one or more of the basic components or sub-components may be separately or sequentially formed or molded (such as through bi-injection molding). Alternatively, in a non-preferred embodiment, the basic components may be molded initially as one connected, unitary structure, and then broken apart, and then re-assembled into an operative combination or assembly.

Figure 2:
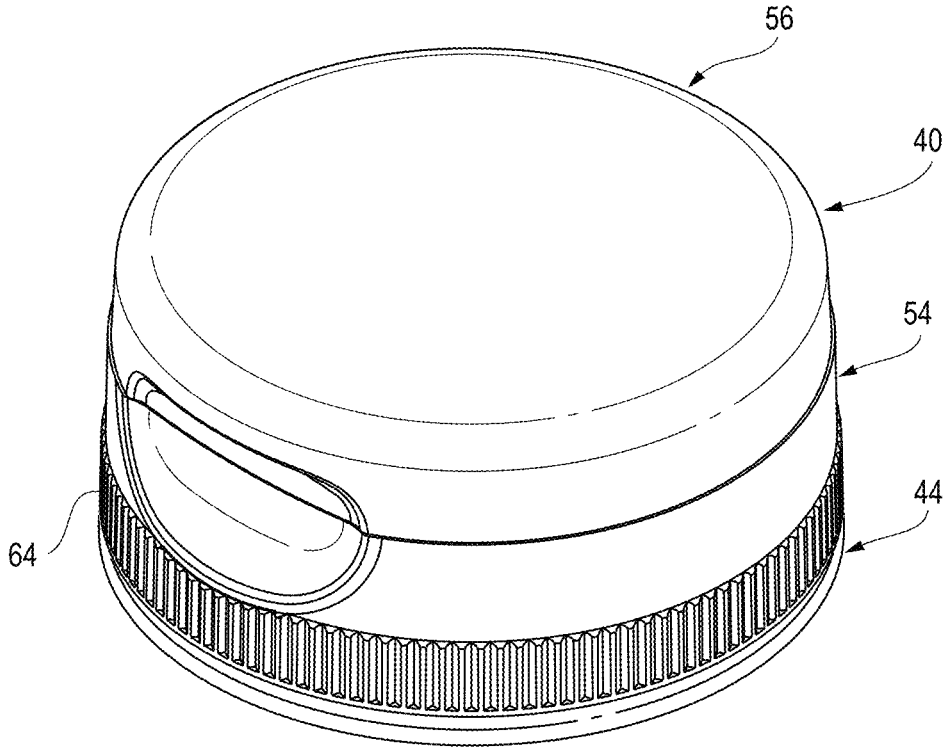
FIG. 2 is an isometric view, from above, of the closure and fragmentary portion of the container assembly of FIG. 1.
Figure 3:
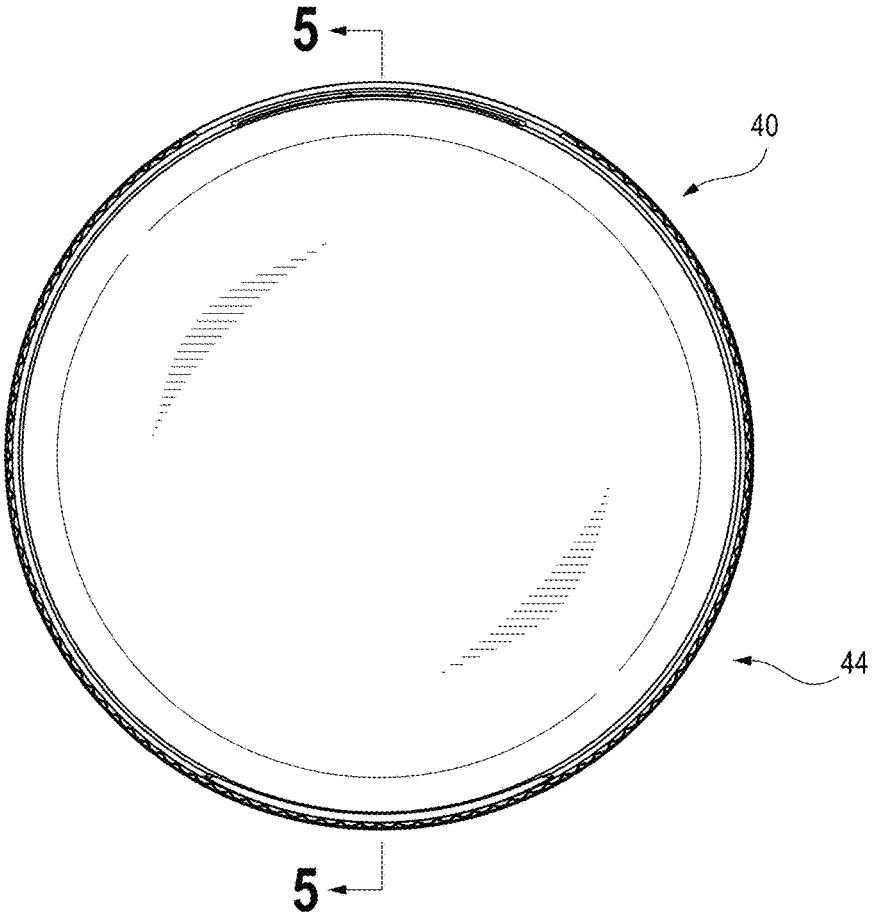
FIG. 3 is a top plan view of the closure and container assembly of FIG. 2.

One method of assembling the closure 40 with the container 44 of a fluent substance to form a package is next discussed. It will be understood that the method of assembly described herein is illustrative only, and there may be other methods of assembling the package. The closure 40, including the body 54 and the lid 56, is preferably molded as a unitary article of manufacture in the lid open position (not illustrated), and then the plug seal 66 of the lid 56 is then placed into a sealing, frictional engagement with the interior of the deck 58 to occlude the orifice 60 of the body 54 (as shown in FIG. 1). The closure 40 is then shipped to a filler facility. The filler facility then fills the container 44 with a pre-determined amount or dose of a substance to be dispensed (not illustrated). With reference to FIG. 5, the closure 40 is brought into mating contact with the container 44 along the axis 45 such that the external threads 49 of the container 44 are received within the internal threads 48 of the internal wall 62 of the body 54 until the top end of the container 44 contacts against the underside of the deck 58 and the seal wall 77 seals against the container opening 46. During relative clockwise rotation of the closure 40 and the container 44, at least a portion of each torque rib 74 is sufficiently flexible and resilient to travel or slide over and past the flanges 76 of the container 44 until reaching a fully-threaded, assembled configuration as illustrated in FIGS. 2 and 5. In the assembled configuration of the closure 40 and the container 44, the end face 94 of each flange 76 is in a confronting relationship with the axially inward extending (i.e., lower), clubbed extension or portion of one respective torque rib 74.

The filled container 44 with the closure 40 installed in the closed position is thus provided to a consumer in the form a completed package.

Figure 4:
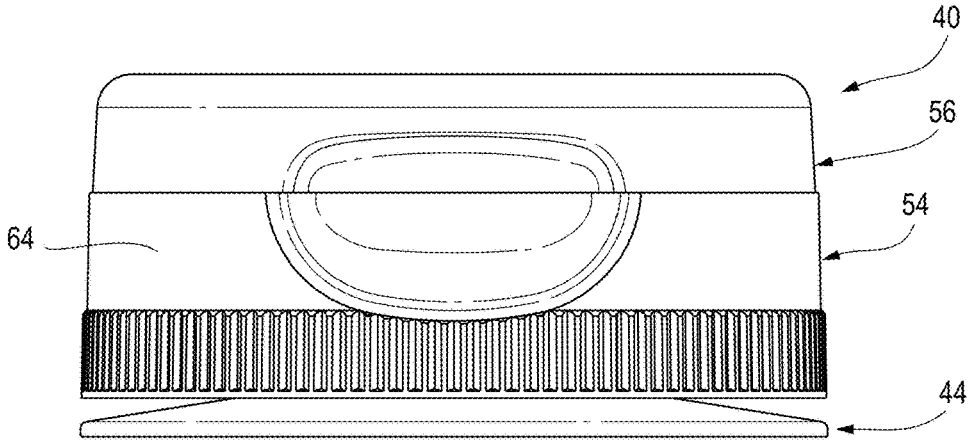
FIG. 4 is a front elevational view of the closure and container assembly of FIG. 2.

The detailed operation and function of the closure 40 will next be described. Typically, a user, such as a customer, will encounter the closure 40 as shown in FIGS. 2 and 4, with the closure 40 installed upon the fluent substance container 44 as a package. It will be understood that only a fragmentary portion of top end or neck of the container 44 is illustrated herein, and that the remaining lower portion of the container 44 may have any configuration sufficient for containing a fluent substance in a given application.

The closure 40 would be typically used for dispensing a substance stored within a container 44, such as shear-thinning, viscous fluid like ketchup or other condiment that is stored in the container 44. The user would grasp the package and lift upwardly on a front portion of the lid 56 to disengage the plug seal 66 from the orifice 60 in the deck 58 to rotate the lid 56 relative to the body 54 about the hinge 65.

The user may grasp the flexible, resilient container 44, invert it, and squeeze it to partially collapse, or otherwise reduce the internal volume of the container 44, to pressurize the fluent substance contained therein. During dispensing of the fluent substance, the fluent substance initially enters into the interior volume of the closure body 54, travels the hollow interior of the body 54, and exits the closure 40 from the exposed orifice 60.

When the user ceases to squeeze (i.e., pressurize) the container 44, the outward flow of the fluent substance terminates, and the substance may even be sucked back toward the container 44 by a temporary lower pressure within the container 44 (e.g., if the container has resilient walls that return from a "squeezed in" configuration to the normal, nondeformed configuration). This may allow some or all of the residual fluent substance within the orifice 60 to be forced by the greater ambient air pressure back through the closure 40 and toward the container 44 to help maintain the overall cleanliness of the package. After dispensing a fluent substance through the closure 40, the user may then return the lid 56 to the closed position by rotating the lid 56 about the hinge 65 relative to the closure body 54 such that the lid plug seal 66 re-seals within the orifice 60 of the deck 58.

Importantly, after initial assembly of the closure 40 and the container 44, the user may be prevented or dissuaded from opening the package to tamper with, or refill, the contents by removing the closure 40 from the container 44 by unthreading the mating threads 48 and 49. If the user attempts to unscrew the closure 40 and the container 44 by relative counterclockwise rotation thereof, then each torque rib 74 is driven to engage an end face 94 of an adjacent, confronting flange 76 on the bottle 44. The non-planar, clubbed configuration of each torque rib 74, with its first and second projections 86, 90, provides a sufficiently high interference to rotation (e.g., up to about 40 inch-pounds, and, more preferably, up to about 60 inch-pounds) that approaches the performance of a foil seal or liner.

It will be understood that in one broad form of the present invention, the invention encompasses just the closure 40, which may be used with any container other than the preferred container 44 as set forth herein.

It will further be understood that in another broad form of the present invention, the invention encompasses just the container 44, which may be used with any closure other than the preferred closure 40 as set forth herein.

With reference now to FIGS. 32-37, a second embodiment of a container according to the present invention is designated as 44A. The numbered features of the second embodiment of the container 44A are designated generally with the suffix letter "A" and are analogous to features of the aforementioned first illustrated embodiment of the container 44 that share the same number (without the suffix letter "A"). The second illustrated embodiment of the container 44A operates in substantially the same manner as described in detail above with respect to the first illustrated embodiment of the container 44, and the container 44A has the same basic features of one or more radially extending flanges 76A that surround the opening 46A on the neck of the container 44A, at a location that is axially inwardly (below) the location of threads 49A. The flanges 76A function to permit the torque ribs 74 of the closure 40 to pass non-destructively during initial installation or threading of the closure 40 in the clockwise direction relative to the container 44A, and further function to prevent or inhibit unthreading of the closure 40 from the container 44A in the counterclockwise direction. Each one of the flanges 76A has a fin-shaped profile, when viewed in a plane that is normal to the central axis 45A (as viewed in FIG. 32) and includes an axially outwardly (i.e., vertically) extending ramp 92A and a substantially flat end face 94A to confront one of the torque ribs 74.

Figure 35:
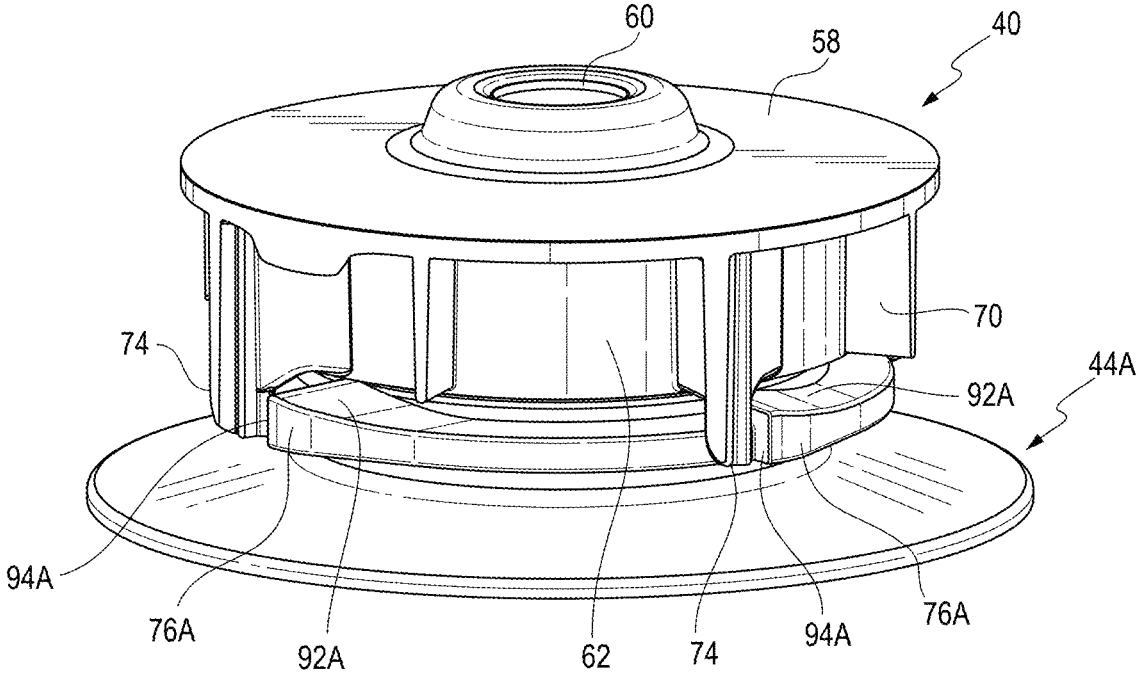
FIG. 35 is a simplified, isometric view of the closure of FIG. 1 assembled with the container of FIG. 32.

With reference to FIGS. 34, 35, and 37, it can be seen that the container 44A differs from the above-discussed first embodiment 40 in that the container 44A has a more gradually-sloping ramp 92A leading to the flat end face 94A. Preferably, the angle of the slope, as measured relative to a horizontal plane that is normal to the central axis 45A, is between about 5 and 15 degrees, and more preferably is about 11 degrees. The angle of the slope of the ramp 92 of the first illustrated embodiment of the closure 40 is between about 40 and 50 degrees, by comparison.

The inventors have found that providing the closure 40 and container 44A of the present invention provides a simple to manufacture closure design that prevents, or at least minimizes, the potential for a user to tamper with, or refill, an assembly of the closure 40 and the container 44A. The inventors have further discovered that the assembly of the closure 40 and the container 44A may advantageously provide sufficiently high resistance to an opening torque so as to eliminate the need for a secondary seal or foil liner that would increase the cost and difficulty of the recyclability of the assembly. Furthermore, the assembly of the closure 40 and the container 44A may advantageously be assembled more easily in that the gradual slope of the ramp 92A can minimize or at least reduce large spikes of force when rotating the closure 40 relative to the container 44A.

Other configurations of the present invention are set forth in the claims.

Various modifications and alterations to this invention will become apparent to those skilled in the art without departing from the scope and spirit of this invention. Illustrative embodiment and examples of the closure and container are provided as examples only and are not intended to limit the broadest scope of the present invention.

What is claimed is:

1. A closure for use in restricting access to a substance that may be stored within a container, the container having an opening and at least one laterally extending flange located laterally outwardly of the opening, said closure comprising:

a body for being located at the opening of the container, said body having a deck, said deck defining an interior side and an exterior side and a central axis extending between said interior and said exterior sides, said deck including at least one orifice communicating between said interior side and said exterior side, said body having an internal wall depending from said deck with means for attaching said closure to the container, said body having at least one torque rib extending therefrom for confronting the at least one laterally extending flange of the container to inhibit relative rotation between said body and the container, and said at least one torque rib being non-planar; said body further comprising a skirt depending from said deck and surrounding said internal wall, wherein said at least one torque rib extends from at least one of said internal wall and/or said skirt; and said body further comprising at least one reinforcing rib extending between said internal wall and said skirt, wherein said at least one torque rib extends transversely from said reinforcing rib.

2. The closure of claim 1 wherein said at least one torque rib extends axially inwardly of said reinforcing rib.

3. The closure of claim 1 wherein said at least one reinforcing rib is planar and extends radially relative to said central axis.

4. The closure of claim 1 further comprising a plurality of torque ribs, wherein in an assembled configuration with the container said body is configured to resist rotation relative to the container when subjected to a torque up to about 40 inch-pounds (4.5 N-m).

5. The closure of claim 1 further comprising a plurality of torque ribs, wherein in an assembled configuration with the container said body is configured to resist rotation relative to the container when subjected to a torque up to about 60 inch-pounds (6.8 N-m).

6. The closure of claim 1 wherein said means on said internal wall includes at least one screw thread for mating with at least one screw thread on the container.

7. The closure of claim 1 further comprising a lid connected to said body, said lid being movable between i) a closed position occluding said at least one orifice, and ii) an open position exposing said at least one orifice to permit communication of a substance through said body.

8. The closure of claim 1 further comprising a plurality of torque ribs, wherein said body is configured to move from an unassembled configuration with the container into an assembled configuration with the container when subjected to a torque not exceeding about 20 inch-pounds (2.25 N-m).

9. The closure of claim 1 in combination with a container for a fluent substance, said container having an opening and at least one laterally extending flange located laterally outwardly of said opening.

10. The closure and container combination of claim 9 wherein said at least one laterally extending flange is fin-shaped and defines a flat end face for confronting said at least one torque rib of said body.

11. The closure and container combination of claim 10 wherein said at least one laterally extending flange defines an axially extending ramp proximate to said flat end face.

12. The closure and container combination of claim 9 wherein said closure includes a plurality of said torque ribs and said container includes a plurality of laterally extending flanges, wherein in an assembled condition of said closure and said container, said body is configured to resist rotation relative to the container when subjected to a torque up to about 40 inch-pounds (4.5 N-m).

13. The closure and container combination of claim 9 wherein said closure includes a plurality of said torque ribs and said container includes a plurality of laterally extending flanges wherein, in an assembled condition of said closure and said container, said body is configured to resist rotation relative to the container when subjected to a torque up to about 60 inch-pounds (6.8 N-m).

14. The closure and container combination of claim 9 wherein said closure includes a plurality of torque ribs and said container includes a plurality of laterally extending flanges, wherein said body is configured to move from an unassembled configuration with said container into an assembled configuration with said container when subjected to a torque not exceeding about 20 inch-pounds (2.25 N-m).

15. The closure and container combination of claim 9 wherein said at least one laterally extending flange defines an axially extending ramp, said ramp being angled relative to a horizontal plane between about 5 and 15 degrees.

16. The closure of claim 1 in combination with a container of a fluent substance, said closure, container, and fluent substance together defining a package.

17. A closure for use in restricting access to a substance that may be stored within a container, the container having an opening and at least one laterally extending flange located laterally outwardly of the opening, said closure comprising:

a body for being located at the opening of the container, said body having a deck, said deck defining an interior side and an exterior side and a central axis extending between said interior and said exterior sides, said deck including at least one orifice communicating between said interior side and said exterior side, said body having an internal wall depending from said deck with means for attaching said closure to the container, said body having at least one torque rib extending therefrom for confronting the at least one laterally extending flange of the container to inhibit relative rotation between said body and the container, and said at least one torque rib being non-planar;

wherein said at least one torque rib defines a laterally outward side facing away from said central axis and a laterally inward side facing toward said central axis, and said laterally outward side includes a first triangular projection.

18. The closure of claim 17 wherein said at least one torque rib defines a laterally outward side facing away from said central axis and a laterally inward side facing toward said central axis, and said laterally inward side includes a second triangular projection.

19. A closure for use in restricting access to a substance that may be stored within a container, the container having an opening and at least one laterally extending flange located laterally outwardly of the opening, said closure comprising:

a body for being located at the opening of the container, said body having a deck, said deck defining an interior side and an exterior side and a central axis extending between said interior and said exterior sides, said deck including at least one orifice communicating between said interior side and said exterior side, said body having an internal wall depending from said deck with means for attaching said closure to the container, said body having at least one torque rib extending therefrom for confronting the at least one laterally extending flange of the container to inhibit relative rotation between said body and the container, and said at least one torque rib being non-planar;

wherein said at least one torque rib defines a laterally outward side facing away from said central axis and a laterally inward side facing toward said central axis, said laterally outward side includes a first triangular projection, and said laterally inward side includes a second triangular projection oppositely facing relative to said first triangular projection.

20. The closure of claim 19 wherein said first triangular projection has a first distal tip defining a first interior angle, said second triangular projection has a second distal tip defining a second interior angle, and said second interior angle is greater than said first interior angle.

* * * * *